US010948276B2

(12) United States Patent
Eitschberger

(10) Patent No.: US 10,948,276 B2
(45) Date of Patent: Mar. 16, 2021

(54) PIVOTABLE BULKHEAD ASSEMBLY FOR CRIMP RESISTANCE

(71) Applicant: DynaEnergetics Europe GmbH, Troisdorf (DE)

(72) Inventor: Christian Eitschberger, Munich (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 16/423,789

(22) Filed: May 28, 2019

(65) Prior Publication Data

US 2019/0293398 A1 Sep. 26, 2019

Related U.S. Application Data

(60) Continuation of application No. 16/156,339, filed on Oct. 10, 2018, now Pat. No. 10,352,674, which is a continuation of application No. 16/056,944, filed on Aug. 7, 2018, now Pat. No. 10,365,078, which is a division of application No. 15/612,953, filed on Jun. 2, 2017, now Pat. No. 10,066,921, which is a division (Continued)

(51) Int. Cl.
*F42D 1/05* (2006.01)
*F42D 1/04* (2006.01)

(52) U.S. Cl.
CPC ..... *F42D 1/05* (2013.01); *F42D 1/043* (2013.01)

(58) Field of Classification Search
CPC ..... F42D 1/05; F42D 1/043
USPC ..... 102/206
See application file for complete search history.

(56) References Cited

U.S. PATENT DOCUMENTS 2,296,346 A * 9/1942 Hearn ..... H01H 50/443 439/741
2,358,466 A 9/1944 Miller
(Continued)

FOREIGN PATENT DOCUMENTS

CA 2821506 A1 1/2015
CA 2824838 A1 2/2015
(Continued)

OTHER PUBLICATIONS

The Federal Institute of Industrial Property, Office Action of International App. No. 2016109329, which is in the same family as U.S. Appl. No. 16/423,789, dated Jul. 10, 2019, 5 pgs.
(Continued)

*Primary Examiner* — Alexander Gilman
(74) *Attorney, Agent, or Firm* — Moyles IP, LLC

(57) ABSTRACT

According to an aspect a bulkhead assembly is provided having particular application with a downhole tool, in particular for oil well drilling applications. The bulkhead assembly includes a bulkhead body and an electrical contact component disposed within the bulkhead body, wherein at least a portion of the electrical contact component is configured to pivot about its own axis, without compromising its ability to provide a pressure and fluid barrier. In an embodiment, a ground apparatus is provided to provide an electrical connection for at least one ground wire. The ground apparatus may be positionable on the bulkhead body of the bulkhead assembly. In an aspect, a downhole tool including the bulkhead assembly and ground apparatus is also generally described.

20 Claims, 11 Drawing Sheets

Related U.S. Application Data of application No. 15/068,786, filed on Mar. 14, 2016, now Pat. No. 9,784,549.

(60) Provisional application No. 62/134,893, filed on Mar. 18, 2015.

(56) References Cited

U.S. PATENT DOCUMENTS 2,439,394 A * 4/1948 Lanzalotti ..... H01B 17/301 174/153 R
2,889,775 A 6/1959 Owen
3,013,491 A 12/1961 Poulter
3,158,680 A 11/1964 Lovitt et al.
3,246,707 A 4/1966 Bell
3,374,735 A 3/1968 Moore
3,892,455 A 7/1975 Sotolongo
4,007,796 A 2/1977 Boop
4,058,061 A 11/1977 Mansur, Jr. et al.
4,100,978 A 7/1978 Boop
4,266,613 A 5/1981 Boop
4,290,486 A 9/1981 Regalbuto
4,346,954 A 8/1982 Appling
4,411,491 A 10/1983 Larkin et al.
4,491,185 A 1/1985 McClure
4,523,650 A 6/1985 Sehnert et al.
4,574,892 A 3/1986 Grigar et al.
4,621,396 A 11/1986 Walker et al.
4,650,009 A 3/1987 McClure et al.
4,657,089 A 4/1987 Stout
4,660,910 A 4/1987 Sharp et al.
4,744,424 A 5/1988 Lendermon et al.
4,747,201 A 5/1988 Donovan et al.
4,776,393 A 10/1988 Forehand et al.
4,859,196 A 8/1989 Durando et al.
5,027,708 A 7/1991 Gonzalez et al.
5,042,594 A 8/1991 Gonzalez et al.
5,052,489 A 10/1991 Carisella et al.
5,060,573 A 10/1991 Montgomery et al.
5,083,929 A 1/1992 Dalton
5,105,742 A 4/1992 Sumner
5,159,145 A 10/1992 Carisella et al.
5,223,665 A 6/1993 Burleson et al.
5,237,136 A 8/1993 Langston
5,241,891 A 9/1993 Hayes et al.
5,322,019 A 6/1994 Hyland
5,347,929 A 9/1994 Lerche et al.
5,358,418 A * 10/1994 Carmichael ..... E21B 17/028 166/65.1
5,392,851 A 2/1995 Arend
5,392,860 A 2/1995 Ross
5,436,791 A 7/1995 Turano et al.
5,529,509 A 6/1996 Hayes et al.
5,558,531 A 9/1996 Ikeda et al.
5,603,384 A 2/1997 Bethel et al.
5,679,032 A 10/1997 Auclair
5,759,056 A 6/1998 Costello et al.
5,765,962 A 6/1998 Cornell et al.
5,769,661 A 6/1998 Nealis
5,775,426 A 7/1998 Snider et al.
5,797,761 A 8/1998 Ring
5,871,052 A 2/1999 Benson et al.
5,927,402 A 7/1999 Benson et al.
D417,252 S 11/1999 Kay
5,992,289 A 11/1999 George et al.
6,006,833 A 12/1999 Burleson et al.
6,012,525 A 1/2000 Burleson et al.
6,263,283 B1 7/2001 Snider et al.
6,297,447 B1 * 10/2001 Burnett ..... H01R 9/0524 174/40 CC
6,298,915 B1 10/2001 George
6,315,461 B1 * 11/2001 Cairns ..... G02B 6/3816 385/56
6,354,374 B1 3/2002 Edwards et al.
6,582,251 B1 * 6/2003 Burke ..... H01R 13/5202 439/589
6,651,747 B2 11/2003 Chen et al.
6,742,602 B2 6/2004 Trotechaud
6,752,083 B1 6/2004 Lerche et al.
6,772,868 B2 8/2004 Warner
6,851,471 B2 2/2005 Barlow et al.
6,902,414 B2 * 6/2005 Dopf ..... E21B 17/028 439/140
6,976,857 B1 12/2005 Shukla et al.
7,036,598 B2 5/2006 Skjærseth et al.
7,074,064 B2 * 7/2006 Wallace ..... H01R 13/523 166/65.1
7,182,611 B2 2/2007 Borden et al.
7,193,156 B2 3/2007 Alznauer et al.
7,237,626 B2 * 7/2007 Gurjar ..... E21B 17/028 166/65.1
7,322,416 B2 1/2008 Burris, II et al.
7,364,451 B2 4/2008 Ring et al.
7,404,725 B2 * 7/2008 Hall ..... E21B 17/028 439/194
7,481,662 B1 1/2009 Rehrig
7,510,017 B2 3/2009 Howell et al.
7,553,078 B2 6/2009 Hanzawa et al.
7,661,474 B2 2/2010 Campbell et al.
7,726,396 B2 6/2010 Briquet et al.
7,748,447 B2 7/2010 Moore
7,762,351 B2 7/2010 Vidal
7,901,247 B2 3/2011 Ring
7,952,035 B2 5/2011 Falk et al.
7,980,874 B2 7/2011 Finke et al.
8,069,789 B2 12/2011 Hummel et al.
8,079,296 B2 * 12/2011 Barton ..... F42D 1/043 89/1.15
8,091,477 B2 1/2012 Brooks et al.
8,136,439 B2 3/2012 Bell
8,181,718 B2 5/2012 Burleson et al.
8,186,259 B2 5/2012 Burleson et al.
8,387,533 B2 3/2013 Runkel
8,449,308 B2 5/2013 Smith
8,469,087 B2 6/2013 Gray
8,863,665 B2 10/2014 DeVries et al.
8,869,887 B2 * 10/2014 Deere ..... E21B 33/0385 166/242.6
8,875,787 B2 11/2014 Tassaroli
8,910,718 B2 12/2014 Watson et al.
8,950,480 B1 2/2015 Strickland
8,985,023 B2 3/2015 Mason
8,997,852 B1 4/2015 Lee et al.
9,080,433 B2 7/2015 Lanclos et al.
9,145,764 B2 9/2015 Burton et al.
9,175,553 B2 11/2015 Mccann et al.
9,181,790 B2 11/2015 Mace et al.
9,194,219 B1 11/2015 Hardesty et al.
9,270,051 B1 2/2016 Christiansen et al.
9,328,577 B2 5/2016 Hallundbaek et al.
9,382,783 B2 7/2016 Langford et al.
9,441,465 B2 9/2016 Tassaroli
9,441,470 B2 9/2016 Guerrero et al.
9,466,916 B2 10/2016 Li et al.
9,476,289 B2 * 10/2016 Wells ..... E21B 33/134
9,484,646 B2 * 11/2016 Thomas ..... H01R 9/0521
9,494,021 B2 11/2016 Parks et al.
9,518,443 B2 12/2016 Tunget et al.
9,518,454 B2 12/2016 Current et al.
9,570,897 B2 2/2017 Dobrinski et al.
9,581,422 B2 2/2017 Preiss et al.
9,598,942 B2 * 3/2017 Wells ..... E21B 43/1185
9,605,937 B2 3/2017 Eitschberger et al.
9,634,427 B2 4/2017 Lerner et al.
9,677,363 B2 6/2017 Schacherer et al.
9,689,223 B2 6/2017 Schacherer et al.
9,702,680 B2 7/2017 Parks et al.
9,784,549 B2 10/2017 Eitschberger
9,835,015 B2 12/2017 Hardesty
9,874,083 B2 1/2018 Logan et al.
9,926,755 B2 3/2018 Van Petegem et al.
9,963,955 B2 5/2018 Tolman et al.
10,001,007 B2 6/2018 Pelletier et al.

(56) References Cited

U.S. PATENT DOCUMENTS

| | | | | |
|---|---|---|---|---|
| 10,036,236 | B1 | 7/2018 | Sullivan et al. | |
| 10,053,968 | B2 | 8/2018 | Tolman et al. | |
| 10,066,921 | B2 | 9/2018 | Eitschberger | |
| 10,077,641 | B2 | 9/2018 | Rogman et al. | |
| 10,151,181 | B2 | 12/2018 | Lopez et al. | |
| 10,174,595 | B2 | 1/2019 | Knight et al. | |
| 10,188,990 | B2 | 1/2019 | Burmeister et al. | |
| 10,273,788 | B2 | 4/2019 | Bradley et al. | |
| 10,301,910 | B2 | 5/2019 | Whitsitt et al. | |
| 10,337,270 | B2 | 7/2019 | Carisella et al. | |
| 10,352,136 | B2 | 7/2019 | Goyeneche | |
| 10,429,161 | B2 | 10/2019 | Parks et al. | |
| 10,458,213 | B1 | 10/2019 | Eitschberger et al. | |
| 10,472,901 | B2 | 11/2019 | Engel et al. | |
| 10,472,938 | B2 | 11/2019 | Parks et al. | |
| D873,373 | S | 1/2020 | Hartman et al. | |
| 10,677,026 | B2 | 6/2020 | Sokolove et al. | |
| 2004/0094305 | A1 | 5/2004 | Skjærseth et al. | |
| 2005/0186823 | A1* | 8/2005 | Ring | H01R 13/521 439/322 |
| 2005/0229805 | A1 | 10/2005 | Myers, Jr. et al. | |
| 2006/0013282 | A1 | 1/2006 | Hanzawa et al. | |
| 2008/0110612 | A1 | 5/2008 | Prinz et al. | |
| 2008/0110632 | A1 | 5/2008 | Beall | |
| 2008/0134922 | A1 | 6/2008 | Grattan et al. | |
| 2008/0149338 | A1 | 6/2008 | Goodman et al. | |
| 2008/0173204 | A1 | 7/2008 | Anderson et al. | |
| 2008/0264639 | A1 | 10/2008 | Parrott et al. | |
| 2009/0301723 | A1* | 12/2009 | Gray | E21B 23/00 166/301 |
| 2010/0000789 | A1 | 1/2010 | Barton et al. | |
| 2010/0022125 | A1* | 1/2010 | Burris | H01R 9/0521 439/584 |
| 2010/0089643 | A1 | 4/2010 | Vidal | |
| 2010/0163224 | A1 | 7/2010 | Strickland | |
| 2010/0230104 | A1 | 9/2010 | Nölke et al. | |
| 2010/0288496 | A1 | 11/2010 | Cherewyk | |
| 2011/0024116 | A1 | 2/2011 | McCann et al. | |
| 2012/0006217 | A1 | 1/2012 | Anderson | |
| 2012/0094553 | A1 | 4/2012 | Fujiwara et al. | |
| 2012/0152542 | A1 | 6/2012 | Le | |
| 2012/0160483 | A1 | 6/2012 | Carisella | |
| 2012/0199352 | A1 | 8/2012 | Lanclos et al. | |
| 2012/0241169 | A1 | 9/2012 | Hales et al. | |
| 2012/0247769 | A1 | 10/2012 | Schacherer et al. | |
| 2012/0247771 | A1 | 10/2012 | Black et al. | |
| 2012/0298361 | A1 | 11/2012 | Sampson | |
| 2013/0008639 | A1 | 1/2013 | Tassaroli et al. | |
| 2013/0043074 | A1 | 2/2013 | Tassaroli | |
| 2013/0048376 | A1 | 2/2013 | Rodgers et al. | |
| 2013/0126237 | A1 | 5/2013 | Burton et al. | |
| 2013/0153205 | A1 | 6/2013 | Borgfeld et al. | |
| 2013/0199843 | A1 | 8/2013 | Ross | |
| 2014/0000877 | A1 | 1/2014 | Robertson et al. | |
| 2014/0083774 | A1 | 3/2014 | Hoult et al. | |
| 2014/0127941 | A1* | 5/2014 | Lu | H01R 9/05 439/583 |
| 2014/0148044 | A1* | 5/2014 | Balcer | H01R 9/0524 439/460 |
| 2015/0167410 | A1 | 6/2015 | Garber et al. | |
| 2015/0209954 | A1 | 7/2015 | Hokanson | |
| 2015/0330192 | A1 | 11/2015 | Rogman et al. | |
| 2016/0061572 | A1 | 3/2016 | Eitschberger et al. | |
| 2016/0084048 | A1 | 3/2016 | Harrigan et al. | |
| 2016/0115741 | A1 | 4/2016 | Davis | |
| 2016/0168961 | A1 | 6/2016 | Parks et al. | |
| 2016/0202033 | A1 | 7/2016 | Shahinpour et al. | |
| 2016/0215592 | A1 | 7/2016 | Helms et al. | |
| 2016/0273902 | A1 | 9/2016 | Eitschberger | |
| 2016/0290084 | A1 | 10/2016 | LaGrange et al. | |
| 2016/0298404 | A1 | 10/2016 | Beckett et al. | |
| 2016/0356132 | A1 | 12/2016 | Burmeister et al. | |
| 2017/0030693 | A1 | 2/2017 | Preiss et al. | |
| 2017/0052011 | A1 | 2/2017 | Parks et al. | |
| 2017/0067303 | A1 | 3/2017 | Thiemann et al. | |
| 2017/0138150 | A1 | 5/2017 | Yencho | |
| 2017/0159379 | A1 | 6/2017 | Metcalf et al. | |
| 2017/0167233 | A1 | 6/2017 | Sampson et al. | |
| 2017/0175488 | A1 | 6/2017 | Lisowski et al. | |
| 2017/0199015 | A1 | 7/2017 | Collins et al. | |
| 2017/0204687 | A1 | 7/2017 | Yorga et al. | |
| 2017/0211363 | A1 | 7/2017 | Bradley et al. | |
| 2017/0241244 | A1 | 8/2017 | Barker et al. | |
| 2017/0268860 | A1 | 9/2017 | Eitschberger | |
| 2017/0276465 | A1 | 9/2017 | Parks et al. | |
| 2017/0298716 | A1 | 10/2017 | McConnell et al. | |
| 2017/0306710 | A1 | 10/2017 | Trydal et al. | |
| 2017/0314373 | A9 | 11/2017 | Bradley et al. | |
| 2018/0030334 | A1 | 2/2018 | Collier et al. | |
| 2018/0119529 | A1 | 5/2018 | Goyeneche | |
| 2018/0202789 | A1 | 7/2018 | Parks et al. | |
| 2018/0202790 | A1 | 7/2018 | Parks et al. | |
| 2018/0209250 | A1 | 7/2018 | Daly et al. | |
| 2018/0299239 | A1 | 10/2018 | Eitschberger et al. | |
| 2018/0318770 | A1 | 11/2018 | Eitschberger et al. | |
| 2019/0040722 | A1 | 2/2019 | Yang et al. | |
| 2019/0048693 | A1 | 2/2019 | Henke et al. | |
| 2019/0049225 | A1 | 2/2019 | Eitschberger | |
| 2019/0085685 | A1 | 3/2019 | McBride | |
| 2019/0162055 | A1 | 5/2019 | Collins et al. | |
| 2019/0162056 | A1 | 5/2019 | Sansing | |
| 2019/0195054 | A1 | 6/2019 | Bradley et al. | |
| 2019/0211655 | A1 | 7/2019 | Bradley et al. | |
| 2019/0234188 | A1 | 8/2019 | Goyeneche | |
| 2019/0257181 | A1 | 8/2019 | Langford et al. | |
| 2019/0292887 | A1 | 9/2019 | Austin, II et al. | |
| 2019/0330961 | A1 | 10/2019 | Knight et al. | |
| 2019/0338612 | A1 | 11/2019 | Holodnak et al. | |
| 2019/0353013 | A1 | 11/2019 | Sokolove et al. | |
| 2019/0368293 | A1 | 12/2019 | Covalt et al. | |
| 2020/0024934 | A1 | 1/2020 | Eitschberger et al. | |
| 2020/0024935 | A1 | 1/2020 | Eitschberger et al. | |
| 2020/0032626 | A1 | 1/2020 | Parks et al. | |
| 2020/0063537 | A1 | 2/2020 | Langford et al. | |
| 2020/0063553 | A1 | 2/2020 | Zemla et al. | |
| 2020/0088011 | A1 | 3/2020 | Eitschberger et al. | |
| 2020/0182025 | A1 | 6/2020 | Brady | |
| 2020/0199983 | A1 | 6/2020 | Preiss et al. | |

FOREIGN PATENT DOCUMENTS

| | | | |
|---|---|---|---|
| CA | 2941648 | A1 | 9/2015 |
| CA | 3021913 | A1 | 2/2018 |
| CN | 85107897 | A | 9/1986 |
| CN | 2661919 | | 12/2004 |
| CN | 201209435 | | 3/2009 |
| CN | 201428439 | | 3/2010 |
| CN | 101691837 | B | 4/2010 |
| CN | 201507296 | U | 6/2010 |
| CN | 201620848 | U | 11/2010 |
| CN | 202431259 | U | 9/2012 |
| CN | 103993861 | A | 8/2014 |
| CN | 204430910 | U | 7/2015 |
| CN | 207847603 | U | 9/2018 |
| CN | 209195374 | U | 8/2019 |
| CN | 110424930 | A | 11/2019 |
| CN | 209780779 | U | 12/2019 |
| CN | 209908471 | U | 1/2020 |
| EP | 0180520 | B1 | 5/1991 |
| EP | 0416915 | B1 | 1/1995 |
| EP | 1688584 | B1 | 8/2011 |
| GB | 2531450 | B | 2/2017 |
| GB | 2544247 | A | 5/2017 |
| GB | 2544247 | A | 5/2017 |
| GB | 2548101 | A | 9/2017 |
| GB | 2548203 | A | 9/2017 |
| RU | 2175379 | C2 | 10/2001 |
| RU | 2489567 | C1 | 8/2013 |
| WO | 2015006869 | A1 | 1/2015 |
| WO | WO-2015006869 | A1 | 1/2015 |
| WO | 2015028204 | A2 | 3/2015 |
| WO | WO-2015028204 | A2 | 3/2015 |
| WO | 2015134719 | A1 | 9/2015 |

(56) References Cited

FOREIGN PATENT DOCUMENTS

| | | | |
|---|---|---|---|
| WO | WO-2015134719 | A1 | 9/2015 |
| WO | 2018009223 | A1 | 1/2018 |
| WO | 2019148009 | A2 | 8/2019 |
| WO | 2019204137 | A1 | 10/2019 |

OTHER PUBLICATIONS

Canadian Intellectual Property Office, Office Action of International App. No. CA3,015,102, which is in the same family as U.S. Appl. No. 16/423,789, dated Jun. 17, 2019, 4 pgs.
Canadian Intellectual Property Office, Office Action for CA App. No. 2923860 dated Jul. 14, 2017, which is in the same family as U.S. Appl. Nos. 15/612,953 and 15/068,786, 3 pages.
Canadian Intellectual Property Office, Office Action for CA App. No. 2923860 dated Nov. 25, 2016, which is in the same family as U.S. Appl. Nos. 15/612,953 and 15/068,786, 3 pages.
Burndy, Bulkhead Ground Connector, Mechanical Summary Sheet, The Grounding Superstore, Jul. 15, 2014, 1 page, https://www.burndy.com/docs/default-source/cutsheets/bulkhead-connect.
Djresource, Replacing Signal and Ground Wire, 5/012007, 2 pages, http://www.djresource.eu/Topics/story/110/Technics-SL-Replacing-Signal-and-Ground-Wire/.
Jim Gilliat and Khaled Gasmi, New Select-Fire System, Technical Presentation, Baker Hughes, 2012, 16 pages, http://www.perforators.org/wp-content/uploads.
Owens Oil Tools, E & B Select Fire Side Port Tandem Sub Assembly, Dec. 2012, 9 pgs., https://www.corelab.com/owen/CMS/docs/Manuals/gunsys/MAN-30-XXX-0002-96-R00.pdf.
Dynaenergetics, Through Wire Grounded Bulkhead (DynaTWG). May 25, 2016, 1 pg., https://www.dynaenergetics.com/uploads/files/5756f884e289a_U233%20DynaTWG%20Bulkhead.pdf.
Chinese Office Action for CN Appl. No. 201610153426.X, which is in the same family as U.S. Appl. No. 16/156,339 dated Mar. 20, 2019, 6 pgs.
Amit Govil, Selective Perforation: A Game Changer in Perforating Technology—Case Study, presented at the 2012 European and West African Perforating Symposium, Schlumberger, Nov. 7-9, 2012, 14 pgs.
Brazilian Patent and Trademark Office; Search Report for BR Application No. BR112015033010-0; dated May 5, 2020; (4 pages).
Canadian Intellectual Property Office; Office Action for CA Appl. No. 2,821,506; dated Mar. 21, 2019; 4 pages.
Core Lab, ZER0180™ Gun SystemAssembly and Arming Procedures, 2015, 33 pgs., https://www.corelab.com/owen/CMS/docs/Manuals/gunsys/zero180/MAN-Z180-000.pdf.
Dynaenergetics GMBH & Co. KG, Patent Owners Response to Hunting Titan's Petition for Inter Parties Review—Case IPR2018-00600, filed Dec. 6, 2018, 73 pages.
DynaEnergetics GmbH & Co. KG; Case No. IPR2018-00600; Patent Owner's Motion to Amend; filed Dec. 6, 2018, 53 pgs.
Dynaenergetics GmbH & Co. KG; Patent Owner's Precedential Opinion Panel Request for Case IPR2018-00600; Sep. 18, 2019, 2 pg.
Dynaenergetics, Selective Perforating Switch, Product Information Sheet, May 27, 2011, 1 pg.
EP Patent Office—International Searching Authority, PCT Search Report and Written Opinion for PCT Application No. PCT/EP2014/065752, dated May 4, 2015, 12 pgs.
Eric H. Findlay, Jury Trial Demand in Civil Action No. 6:20-cv-00069-ADA, dated Apr. 22, 2020, 32 pages.
European Patent Office; International Search Report and Written Opinion for PCT Application No. PCT/EP2014/065752 dated May 4, 2015; 12 pgs.
European Patent Office; Invitation to Correct Deficiencies noted in the Written Opinion for European App. No. 15721178.0; dated Dec. 13, 2016; 2 pages.
European Patent Office; Office Action for EP App. No. 15721178.0; dated Sep. 6, 2018; 5 pages.
Federal Institute of Industrial Property; Decision on Granting a Patent for Invention Russian App. No. 2016139136/03(062394); dated Nov. 8, 2018; 20 pages (Eng Translation 4 pages); Concise Statement of Relevance: Search Report at 17-18 of Russian-language document lists several 'A' references based on RU application claims.
Federal Institute of Industrial Property; Inquiry for RU App. No. 2016104882/03(007851); dated Feb. 1, 2018; 7 pages, English Translation 4 pages.
Federal Institute of Industrial Property; Inquiry for RU Application No. 2016110014/03(015803); issued Feb. 1, 2018; 6 pages (Eng. Translation 4 pages).
GB Intellectual Property Office, Examination Report for GB App. No. GB1600085.3, dated Mar. 9, 2016, 1 pg.
GB Intellectual Property Office, Search Report for App. No. GB 1700625.5; dated Jul. 7, 2017; 5 pgs.
GB Intellectual Property Office; Examination Report for GB Appl. No. 1717516.7; dated Apr. 13, 2018; 3 pages.
GB Intellectual Property Office; Office Action for GB App. No. 1717516.7; dated Feb. 27, 2018; 6 pages.
GB Intellectual Property Office; Search Report for GB. Appl. No. 1700625.5; dated Dec. 21, 2017; 5 pages.
German Patent Office; Office Action for DE App. No. 10 2013 109 227.6; dated May 22, 2014; 8 pgs.
Hunting Energy Service,ControlFire RF Safe ControlFire® RF-Safe Manual, 33 pgs., Jul. 2016, http://www.hunting-intl.com/media/2667160/ControlFire%20RF_Assembly%20Gun%20Loading_Manual.pdf.
Hunting Energy Services Pte Ltd., "H-1 Perforating Gun System"; promotional brochure; Jun. 21, 2019.
Hunting Energy Services Pte Ltd., "H-2 Perforating System"; promotional brochure; Feb. 12, 2020.
Hunting Titan Inc., Petition for Inter Parties Review of U.S. Pat. No. 9,581,422, filed Feb. 16, 2018, 93 pgs.
Hunting Titan, H-1® Perforating Gun System, 2016, 2 pgs., http://www.hunting-intl.com/titan.
Hunting Titan, Wireline Top Fire Detonator Systems, Nov. 24, 2014, 2 pgs, http://www.hunting-intl.com/titan/perforating-guns-and-setting-tools/wireline-top-fire-detonator-systems.
Industrial Property Office, Czech Republic; Office Action for CZ App. No. PV 2017-675; dated Jul. 18, 2018; 2 pages; Concise Statement of Relevance: Examiner's objection of CZ application claims 1, 7, and 16 based on US Pub No. 20050194146 alone or in combination with WO Pub No. 2001059401.
Industrial Property Office, Czech Republic; Office Action for CZ App. No. PV 2017-675; dated Oct. 26, 2018; 2 pages.
Industrial Property Office, Czech Republic; Office Action; CZ App. No. PV 2017-675; dated Dec. 17, 2018; 2 pages.
Instituto Nacional De La Propiedad Industrial; Office Action for AR Appl. No. 20140102653; dated May 9, 2019 (1 page).
Intellectual Property India, Office Action of IN Application No. 201647004496, dated Jun. 7, 2019, 6 pgs.
International Searching Authority, International Preliminary Report on Patentability for PCT App. No. PCT/EP2014/065752; dated Mar. 1, 2016, 10 pgs.
International Searching Authority, International Search Report and Written Opinion for PCT App. No. PCT/IB2019/000526; dated Sep. 25, 2019, 17 pgs.
International Searching Authority, International Search Report and Written Opinion for PCT App. No. PCT/IB2019/000537; dated Sep. 25, 2019, 18 pgs.
International Searching Authority, International Search Report and Written Opinion for PCT App. No. PCT/IB2019/000569; dated Oct. 9, 2019, 12 pages.
International Searching Authority; International Preliminary Report on Patentability for PCT Appl. No. PCT/CA2014/050673; dated Jan. 19, 2016; 5 pages.
International Searching Authority; International Search Report and Written Opinion for PCT App. No. PCT/CA2014/050673; dated Oct. 9, 2014; 7 pages.
International Searching Authority; International Search Report and Written Opinion for PCT App. No. PCT/EP2015/059381; dated Nov. 23, 2015; 14 pages.

(56) References Cited

OTHER PUBLICATIONS

International Searching Authority; International Search Report and Written Opinion for PCT App. No. PCT/EP2019/066919; dated Sep. 10, 2019; 11 pages.
International Searching Authority; International Search Report and Written Opinion for PCT App. No. PCT/EP2019/069165; dated Oct. 22, 2019; 13 pages.
International Searching Authority; International Search Report and Written Opinion for PCT App. No. PCT/EP2019/072032; dated Nov. 15, 2019; 13 pages.
International Searching Authority; International Search Report and Written Opinion for PCT App. No. PCT/EP2019/072064; dated Nov. 20, 2019; 15 pages.
International Searching Authority; International Search Report and Written Opinion for PCT App. No. PCT/US2015/018906; dated Jul. 10, 2015; 12 pages.
International Searching Authority; PCT Search Report and Written Opinion for PCT App No. PCT/EP2014/065752; dated May 4, 2015; 12 pgs.
Jet Research Center Inc., JRC Catalog, 36 pgs., https://www.jetresearch.com/content/dam/jrc/Documents/Books_Catalogs/06_Dets_pdf.
Jet Research Center, Velocity™ Perforating System Plug and Play Guns for Pumpdown Operation, Ivarado, Texas, Jul. 2019, 8 pgs., https://www.jetresearch.com/content/dam/jrc/Documents/Brochures/jrc-velocity-perforating-system.pdf.
Nexus Perforating; Double Nexus Connect; 1 page, https://www.nexusperforating.com/double-nexus-connect.
Norwegian Industrial Property Office; Office Action and Search Report for NO App. 20160017; dated Jun. 15, 2017; 5 pages.
United States Patent and Trademark Office, Office Action of U.S. Appl. No. 16/585,790, dated Nov. 12, 2019, 9 pgs.
United States Patent and Trademark Office, Office Action of U.S. Appl. No. 16/809,729, dated Jun. 19, 2020, 9 pgs.
United States Patent and Trademark Office, Office Action of U.S. Appl. No. 16/858,041, dated Jun. 16, 2020, 11 pgs.
United States Patent and Trademark Office, Office Action of U.S. Appl. No. 29/733,080, dated Jun. 26, 2020, 8 pgs.
United States Patent and Trademark Office, Office Action of U.S. Appl. No. 29/733,325, dated Jun. 26, 2020, 9 pgs.
United States Patent and Trademark Office; Final Office Action of U.S. Appl. No. 16/540,484; dated Mar. 30, 2020; 12 pgs.
United States Patent and Trademark Office; Non-Final Office Action for U.S. Appl. No. 15/068,786; dated Mar. 27, 2017; 9 pages.
United States Patent and Trademark Office; Non-Final Office Action for U.S. Appl. No. 15/612,953; dated Feb. 14, 2018; 10 pages.
United States Patent and Trademark Office; Non-Final Office Action for U.S. Appl. No. 16/056,944; dated Mar. 18, 2019; 12 pages.
United States Patent and Trademark Office; Non-Final Office Action for U.S. Appl. No. 16/156,339; dated Dec. 13, 2018; 8 pages.
Yellow Jacket Oil Tools; Tandem Sub; 2019; 3 pages.
Norwegian Industrial Property Office; Office Action and Search Report for NO App. No. 20171759; dated Jan 14, 2020; 6 pages.
Norwegian Industrial Property Office; Office Action for NO Appl. No. 20160017; dated Dec. 4, 2017; 2 pages.
Norwegian Industrial Property Office; Opinion for NO Appl. No. 20171759; dated Apr. 5, 2019; 1 page.
Owen Oil Tools, E & B Select Fire Side Port, Tandem Sub, Apr. 2010, 2 pgs., https://www.corelab.com/owen/cms/docs/Canada/10A_eandbsystem-01.0-c.pdf.
Owen Oil Tools, Expendable Perforating Guns, Jul. 2008, 7 pgs., https://www.corelab.corn/owen/cms/docs/Canada/10A_erhsc-01.0-c.pdf.
Robert Parrott, Case IPR2018-00600 for U.S. Pat. No. 9,581,422 B2, Declaration regarding Patent Invalidity, dated Jun. 29, 2020, 146 pages.
Schulumberger, Perforating Services Catalog, 2008, 521 pages.
State Intellectual Property Office People'S Republic of China; First Office Action for Chinese App. No. 201811156092.7; dated Jun. 16, 2020; 6 pages (Eng Translation 8 pages).
State Intellectual Property Office, P.R. China; First Office Action for Chinese App No. 201580011132.7; dated Jun. 27, 2018; 5 pages (Eng. Translation 9 pages).
State Intellectual Property Office, P.R. China; First Office Action for CN App. No. 201480047092.7; dated Apr. 24, 2017.
State Intellectual Property Office, P.R. China; First Office Action with full translation for CN App. No. 201480040456.9; dated Mar. 29, 2017; 12 pages (English translation 17 pages).
State Intellectual Property Office, P.R. China; Notification to Grant Patent Right for Chinese App. No. 201580011132.7; dated Apr. 3, 2019; 2 pages (Eng. Translation 2 pages).
State Intellectual Property Office, P.R. China; Second Office Action for CN App. No. 201480040456.9; dated Nov. 29, 2017; 5 pages (English translation 1 page).
State Intellectual Property Office, P.R. China; Second Office Action for CN App. No. 201480047092.7; dated Jan. 4, 2018; 3 pages.
SWM International Inc.; "Thunder Disposable Gun System"; promotional brochure; Oct. 2018.
Thilo Scharf; "DynaEnergetics exhibition and product briefing"; pp. 5-6; presented at 2014 Offshore Technology Conference; May 2014.
Thilo Scharf; "DynaStage & BTM Introduction"; pp. 4-5, 9; presented at 2014 Offshore Technology Conference; May 2014.
U.S. Patent Trial and Appeal Board, Institution of Inter Partes Review of U.S. Pat. No. 9581422, Case PR2018-00600,Aug. 21, 2018, 9 pages.
United States Patent and Trademark Office, Case IPR2018-00600 for U.S. Pat. No. 9,581,422 B2, Reply in Support of Patent Owner's Motion to Amend, dated Mar. 21, 2019, 15 pgs.
United States Patent and Trademark Office, Case IPR2018-00600 for U.S. Pat. No. 9,581,422 B2, DynaEnergetics GmbH & Co. KG's Patent Owner Preliminary Response, dated May 22, 2018, 47 pgs.
United States Patent and Trademark Office, Case IPR2018-00600 for U.S. Pat. No. 9,581,422 B2, Order Granting Precedential Opinion Panel, Paper No. 46, dated Nov. 7, 2019, 4 pgs.
United States Patent and Trademark Office, Case IPR2018-00600 for U.S. Pat. No. 9,581,422 B2, Patent Owner's Decision, Granting Patent Owner's Request for Hearing and Granting Patent Owner's Motion to Amend, dated Jul. 6, 2020, 27 pgs.
United States Patent and Trademark Office, Case IPR2018-00600 for U.S. Pat. No. 9,581,422 B2, Patent Owner's Motion to Amend, dated Dec. 6, 2018, 53 pgs.
United States Patent and Trademark Office, Case IPR2018-00600 for U.S. Pat. No. 9,581,422 B2, Patent Owner's Opening Submission to Precedential Opinion Panel, dated Dec. 20, 2019, 21 pgs.
United States Patent and Trademark Office, Case IPR2018-00600 for U.S. Pat. No. 9,581,422 B2, Patent Owner's Request for Hearing, dated Sep. 18, 2019, 19 pgs.
United States Patent and Trademark Office, Case IPR2018-00600 for U.S. Pat. No. 9,581,422 B2, Patent Owner's Responsive Submission to Precedential Opinion Panel, dated Jan. 6, 2020, 16 pgs.
United States Patent and Trademark Office, Case IPR2018-00600 for U.S. Pat. No. 9,581,422 B2, Patent Owner's Sur-reply, dated Mar. 21, 2019, 28 pgs.
United States Patent and Trademark Office, Case IPR2018-00600 for U.S. Pat. No. 9,581,422 B2, Petitioner's Additional Briefing to the Precedential Opinion Panel, dated Dec. 20, 2019, 23 pgs.
United States Patent and Trademark Office, Case IPR2018-00600 for U.S. Pat. No. 9,581,422 B2, Petitioner's Opposition to Patent Owner's Motion to Amend, dated Mar. 7, 2019, 30 pgs.
United States Patent and Trademark Office, Case IPR2018-00600 for U.S. Pat. No. 9,581,422 B2, Petitioner's Reply Briefing to the Precedential Opinion Panel, dated Jan. 6, 2020, 17 pgs.
United States Patent and Trademark Office, Case IPR2018-00600 for U.S. Pat. No. 9,581,422 B2, Petitioner's Reply in Inter Partes Review of U.S. Pat. No. 9,581,422, dated Mar. 7, 2019, 44 pgs.
United States Patent and Trademark Office, Case PGR 2020-00072 for U.S. Pat. No. 10,429,161 B2, Petition for Post Grant Review of Claims 1-20 of U.S. Pat. No. 10,429,161 Under 35 U.S.C. §§ 321-28 and 37 C.F. R. §§42.200 ET SEQ., dated Jun. 30, 2020, 109 pages.
United States Patent and Trademark Office, Final Written Decision of Case IPR2018-00600 for U.S. Pat. No. 9,581,422 B2, Paper No. 42, dated Aug. 20, 2019, 31 pgs.

(56) References Cited

OTHER PUBLICATIONS

United States Patent and Trademark Office, Non-final Office Action of U.S. Appl. No. 16/451,440, dated Oct. 24, 2019, 22 pgs.
United States Patent and Trademark Office, Non-final Office Action of U.S. Appl. No. 16/455,816, dated Jul. 2, 2020, 15 pgs.
United States Patent and Trademark Office, Non-final Office Action of U.S. Appl. No. 16/455,816, dated Nov. 5, 2019, 17 pgs.
United States Patent and Trademark Office, Office Action of U.S. Appl. No. 14/767,058, dated Jul. 15, 2016, 9 pgs.
United States Patent and Trademark Office, Office Action of U.S. Appl. No. 15/117,228, dated May 31, 2018, 9 pgs.
United States Patent and Trademark Office, Office Action of U.S. Appl. No. 15/617,344, dated Jan 23, 2019, 5 pgs.
United States Patent and Trademark Office, Office Action of U.S. Appl. No. 15/788,367, dated Oct. 22, 2018, 6 pgs.
United States Patent and Trademark Office, Office Action of U.S. Appl. No. 15/920,800, dated Dec. 27, 2019, 6 pgs.
United States Patent and Trademark Office, Office Action of U.S. Appl. No. 15/920,812, dated Dec. 27, 2019, 6 pgs.
United States Patent and Trademark Office, Office Action of U.S. Appl. No. 15/920,812, dated May 27, 2020, 5 pgs.
United States Patent and Trademark Office, Office Action of U.S. Appl. No. 16/026,431, dated Jul. 30, 2019, 10 pgs.
United States Patent and Trademark Office, Office Action of U.S. Appl. No. 16/272,326, dated May 24, 2019. 17 pgs.
United States Patent and Trademark Office, Office Action of U.S. Appl. No. 16/359,540, dated Aug. 14, 2019, 9 pgs.
United States Patent and Trademark Office, Office Action of U.S. Appl. No. 16/359,540, dated May 3, 2019, 11 pgs.
United States Patent and Trademark Office, Office Action of U.S. Appl. No. 16/455,816, dated Apr. 20, 2020, 21 pgs.
United States Patent and Trademark Office, Office Action of U.S. Appl. No. 16/455,816, dated Jan. 13, 2020, 14 pgs.
United States Patent and Trademark Office, Office Action of U.S. Appl. No. 16/540,484, dated Oct. 4, 2019, 12 pgs.
United States Patent and Trademark Office, Notice of Allowance for U.S. Appl. No. 29/729,981, dated Sep. 18, 2020, 9 pages.

* cited by examiner

PIVOTABLE BULKHEAD ASSEMBLY FOR CRIMP RESISTANCE

CROSS-REFERENCE TO RELATED APPLICATIONS

This application is continuation patent application of U.S. application Ser. No. 16/156,339 filed Oct. 10, 2018 (issued as U.S. Pat. No. 10,352,674 on Jul. 16, 2019), which is a continuation of U.S. application Ser. No. 16/056,944 filed Aug. 7, 2018 (issued as U.S. Pat. No. 10,365,078 on Jul. 30, 2019), which is a divisional patent application of U.S. application Ser. No. 15/612,953 filed Jun. 2, 2017 (issued as U.S. Pat. No. 10,066,921 on Sep. 4, 2018), which is a divisional patent application of U.S. application Ser. No. 15/068,786 filed Mar. 14, 2016 (issued as U.S. Pat. No. 9,784,549 on Oct. 10, 2017), which claims the benefit of U.S. Provisional Application No. 62/134,893 filed Mar. 18, 2015, each of which is incorporated herein by reference in its entirety. The present application is also a continuation-in-part patent application U.S. application Ser. No. 16/359,540, filed Mar. 20, 2019 (issued as U.S. Pat. No. 10,472,938 on Nov. 12, 2019), which is a continuation application of U.S. application Ser. No. 15/920,812 filed Mar. 14, 2018, which is a continuation application of U.S. application Ser. No. 15/617,344 filed Jun. 8, 2017 (issued as U.S. Pat. No. 10,429,161 on Oct. 1, 2019), which is a divisional patent application of U.S. application Ser. No. 15/287,309 filed Oct. 6, 2016 (issued as U.S. Pat. No. 9,702,680 on Jul. 11, 2017), which is a divisional patent application of U.S. application Ser. No. 14/904,788 filed on Jan. 13, 2016 (issued as U.S. Pat. No. 9,494,021 on Nov. 15, 2016), which is a national stage entry of PCT Application No. PCT/CA2014/050673 filed Jul. 16, 2014, which claims priority to Canadian Patent Application No. 2821506 filed Jul. 18, 2013.

FIELD

Described generally herein is a bulkhead assembly having a pivotable electric contact component for use with a downhole tool, that is, any piece of equipment that is used in a well.

BACKGROUND

In exploration and extraction of hydrocarbons, such as fossil fuels (e.g. oil) and natural gas, from underground wellbores extending deeply below the surface, various downhole tools are inserted below the ground surface and include sometimes complex machinery and explosive devices. Examples of the types of equipment useful in exploration and extraction, in particular for oil well drilling applications, include logging tools and perforation gun systems and assemblies. It is often useful to be able to maintain a pressure across one or more components, (that is, to provide a "pressure barrier"), as necessary to ensure that fluid does not leak into the gun assembly, for instance. It is not uncommon that components such as a bulkhead and an initiator are components in such perforating gun assemblies that succumb to pressure leakage.

Upon placement into the perforating gun assembly, one or more initiators, (typically a detonator or an igniter), have traditionally required physical connection of electrical wires. The electrical wires typically travel from the surface down to the perforating gun assembly, and are responsible for passing along the surface signal required to initiate ignition. The surface signal typically travels from the surface along the electrical wires that run from the surface to one or more detonators positioned within the perforating gun assembly. Passage of such wires through the perforating gun assembly, while maintaining a pressure differential across individual components, has proved challenging.

Assembly of a perforating gun requires assembly of multiple parts, which typically include at least the following components: a housing or outer gun barrel within which is positioned a wired electrical connection for communicating from the surface to initiate ignition, an initiator or detonator, a detonating cord, one or more charges which are held in an inner tube, strip or carrying device and, where necessary, one or more boosters. Assembly typically includes threaded insertion of one component into another by screwing or twisting the components into place, optionally by use of a tandem-sub adapter. Since the wired electrical connection often must extend through all of the perforating gun assembly, it is easily twisted and crimped during assembly. Further, the wired electrical connections, to a detonator or initiator, usually require use of an electrical ground wire connectable to the electrical wire and extending through the housing in order to achieve a ground contact. When a ground contact is desired, the electrical ground wire must also be connected to an often non-defined part of the perforating gun assembly. Thus, the ground wire is sometimes wedged on or in between threads of hardware components and/or twisted around a metal edge of the housing of the perforating gun assembly. One issue with this arrangement is that it can be a source of intermittent and/or failed electrical contact. In addition, when a wired detonator is used it must be manually connected to the electrical wire, which has lead to multiple problems. Due to the rotating assembly of parts, the electrical ground wires can become compromised, that is to say the electrical ground wires can become torn, twisted and/or crimped/nicked, or the wires may be inadvertently disconnected, or even mis-connected in error during assembly, not to mention the safety issues associated with physically and manually wiring live explosives.

According to the prior art and as shown in FIG. 1, a wired bulkhead 10' of the prior art is depicted. In a perforating gun assembly, the bulkhead 10' may be utilized to accommodate electrical and ballistic transfer (via wired electric connection 170', shown with an insulator 172' covering one end of the electrical contact component 20', which extends through the body of the bulkhead 10') to the electric connection of a next gun assembly in a string of gun assemblies, for as many gun assembly units as may be required depending on the location of underground oil or gas formation. Such bulkhead assemblies are usually provided with fixed pin contacts extending from either end of the assembly. Typically the bulkhead is employed to provide the electrical contact or feed-through in order to send electrical signals to the initiator or a type of switching system. In such applications, the pressure bulkhead is required to remain pressure sealed even under high temperatures and pressures as may be experienced in such applications, both during operation and also after detonation of the perforating gun, for instance, so that a neighboring perforating gun or downhole tool device does not become flooded with wellbore fluid or exposed to the wellbore pressure. Maintenance of the pressure differential across such devices occurs via usage of rubber components including o-rings 32', rubber stoppers and the like.

Such bulkhead assemblies are common components, particularly when a string of downhole tools is required, and is a pressure barrier or component through which electronic componentry and/or electrical wiring and electrical ground wiring must pass, (e.g. electric feed-through), and a need exists to provide such componentry with electric feed-through while maintaining a differential pressure across the component, and without compromising the electrical connection.

Improvements to the way electrical connections are accomplished in this industry include connections and arrangements as found in commonly assigned patent applications PCT/EP2012/056609 (in which an initiator head is adapted to easily introduce external wires into the plug without having to strip the wires of insulation beforehand) and PCT/EP2014/065752 (in which a wireless initiator is provided), which are incorporated herein by reference in their entireties.

The assembly described herein further solves the problems associated with prior known assemblies in that it provides, in an embodiment, an assembly that allows improved assembly in the field while maintaining the integrity of the electrical connection, as described in greater detail hereinbelow.

BRIEF DESCRIPTION

In an embodiment, a bulkhead assembly is provided that includes a bulkhead body configured for pressure sealing components positioned downstream of the bulkhead assembly within a downhole tool and to withstand a pressure of at least about 20,000 psi (137.9 mPa) and an electrical contact component extending through the bulkhead body, such that at least a portion of the electrical contact component is configured to pivot about its own axis, wherein the electrical contact component is configured for electrical conductivity and feed-through of an electric signal.

In an embodiment, the electrical contact component includes a plurality of contact pins that are slidably positioned within a bore of the bulkhead body of the bulkhead assembly.

In an embodiment, a ground apparatus is provided to provide an electrical connection for at least one ground wire. The ground apparatus may be positionable on the bulkhead body of the bulkhead assembly.

In an embodiment, a bulkhead assembly in combination with a downhole tool is provided.

BRIEF DESCRIPTION OF THE FIGURES

A more particular description briefly described above will be rendered by reference to specific embodiments thereof that are illustrated in the appended drawings. Understanding that these drawings depict only typical embodiments and are not therefore to be considered to be limiting of its scope, exemplary embodiments will be described and explained with additional specificity and detail through the use of the accompanying drawings in which.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to embodiments.

DETAILED DESCRIPTION

Reference will now be made in detail to various embodiments. Each example is provided by way of explanation, and is not meant as a limitation and does not constitute a definition of all possible embodiments.

A bulkhead assembly is generally described herein, having particular use in conjunction with a downhole tool, and in particular to applications requiring the bulkhead assembly to maintain a pressure, and is thus commonly referred to as a pressure bulkhead assembly. In an embodiment, the bulkhead assembly is configured for use with a logging tool or a perforating gun assembly, in particular for oil well drilling applications. The bulkhead assembly provides an electrical contact component disposed within a body thereof, wherein at least a portion of the electrical contact component is configured to pivot about its own axis, without compromising its ability to provide a pressure and fluid barrier. A ground apparatus is generally described herein. The ground apparatus may have particular utility with various embodiments of the bulkhead assembly described herein. The ground apparatus provides an electrical connection for at least one ground wire and may be configured to pivot about its own axis when positioned on the bulkhead body of the bulkhead assembly, thereby providing continuous and/or successful electrical contact.

Figure 2:
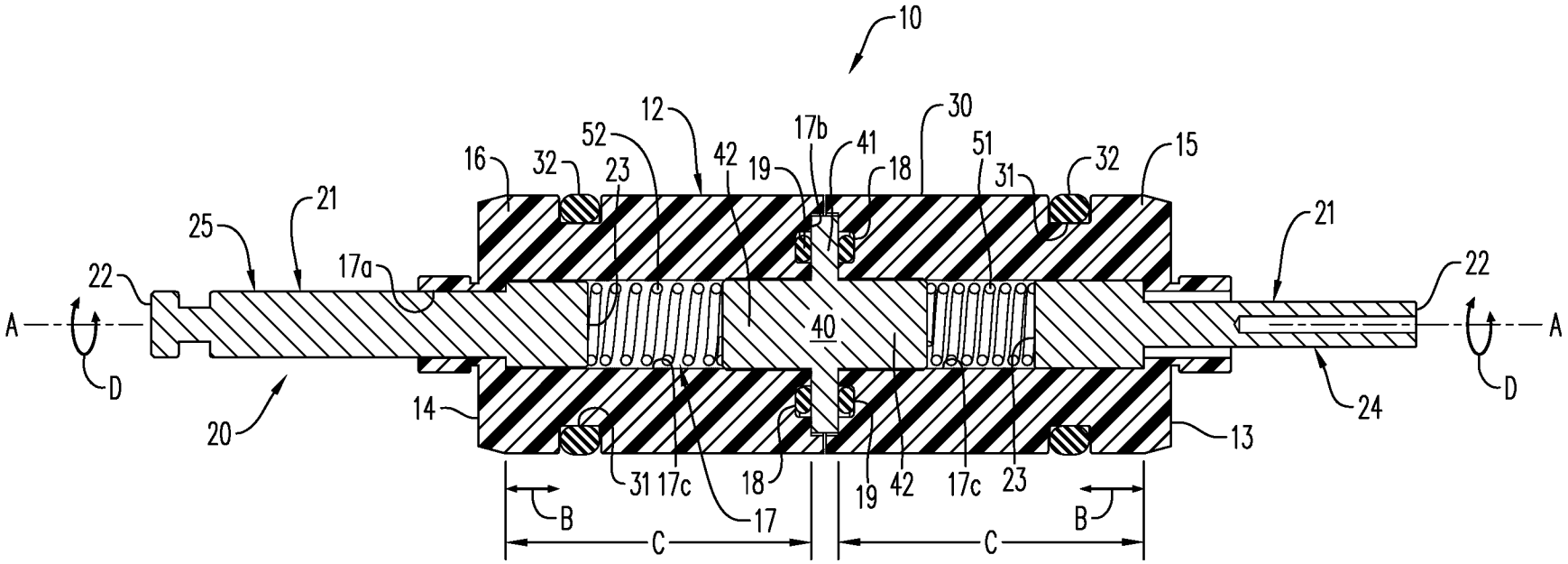
FIG. 2 is a cross-sectional side view of a bulkhead assembly according to an aspect.

With reference to FIG. 2, a bulkhead assembly 10 is provided and is further configured for sealing components positioned downstream of the bulkhead assembly 10 within a downhole tool. In an embodiment, the bulkhead assembly 10 is configured as a pressure-isolating bulkhead and is configured to withstand a pressure of at least about 20,000 psi (137.9 mPa). In an embodiment, the bulkhead assembly 10 is configured to withstand a pressure of at least about 30,000 psi (275.8 mPa). The bulkhead assembly 10 includes a bulkhead body 12 having a first end portion 13 and a second end portion 14 and a bore 17 extending therebetween. It is further envisioned that the bulkhead body 12 includes a first body portion 15 extending from the first end portion 13 towards a center of the bulkhead body 12, and a second body portion 16, extending from the second end portion 14 towards the center of the bulkhead body 12. While it is contemplated that the bulkhead body 12 be made of thermoplastic materials (or otherwise electrically non-conductive materials), it is possible for the bulkhead body 12 to be made of other materials, such as metal (e.g., aluminum with a non-conductive coating). Although the first body portion 15 and the second body portion 16 are depicted as being roughly the same size or otherwise proportioned equally, it is contemplated that these body portions may be dissimilar in size or otherwise disproportionate.

The bulkhead body 12 may be formed as a unitary member or component. Methods of forming the bulkhead body 12 as a unitary member include but are not limited to injection molding and machining the component out of a solid block of material. In an embodiment, the injection molded bulkhead body 12 is formed into a solid material, in which typically a thermoplastic material in a soft or pliable form is allowed to flow around the electrical contact component 20 during the injection molding process.

The bulkhead body 12 includes an outer surface 30, which is configured to be received in a tandem sub 150 as described in greater detail hereinbelow. The outer surface 30 typically includes one or more circumferential indentions 31, which are configured for receiving an outer sealing member 32 in such a way as to seal components positioned downstream of the bulkhead assembly 10 and to withstand typical high pressures experienced in downhole applications.

According to an aspect, the bore 17 extends through the bulkhead body 12, along an axis A-A and typically in the center of the body, and may vary in diameter across the length of the bulkhead body. With particular reference to FIG. 2, the bore 17 may include three sections or portions of varying diameter, although it is possible to configure the bore 17 with one, two, three, or more sections. As depicted in FIG. 2 and in an embodiment, the bore 17 includes an end portion bore 17*a* extending through each of the first body portion 15 and the second body portion 16, a central portion bore 17*b* and mid-portion bores 17*c* extending between the central portion bore 17*b* and the end portion bores 17*a* for a depth or length C. The length C is selected to optimize functionality of the slideable components as described in greater detail hereinbelow. As shown herein and in an embodiment, each end portion bore 17*a* has a smaller radius than the respective mid-portion bore 17*c*, while the central portion bore 17*b* has a larger radius than the mid-portion bores 17*c*.

The bulkhead assembly 10 further includes an electrical contact component 20 extending through the bore 17 of the bulkhead body 12, such that at least a portion of the electrical contact component 20 is configured to pivot about its own axis A-A. Thus, the bulkhead assembly 10 has a pivotable electrical contact component 20. The electrical contact component 20 is configured for electrical conductivity and feed-through of an electric signal. The electrical contact component 20 may thus be formed of any suitable electrically conductive material.

The electrical contact component 20 may include one or more of the following components: a contact pin 21 or wire (not shown), a biasing member 50 (FIG. 3), and/or a central portion 40. It will be understood by one of ordinary skill in the art that although terms like "central" are utilized, such terms are used to describe the positions of some components relative to other components. Although the component may literally be positioned centrally, it is also contemplated that positioning of the components may be de-centralized without detracting from the intended purpose.

Figure 1:
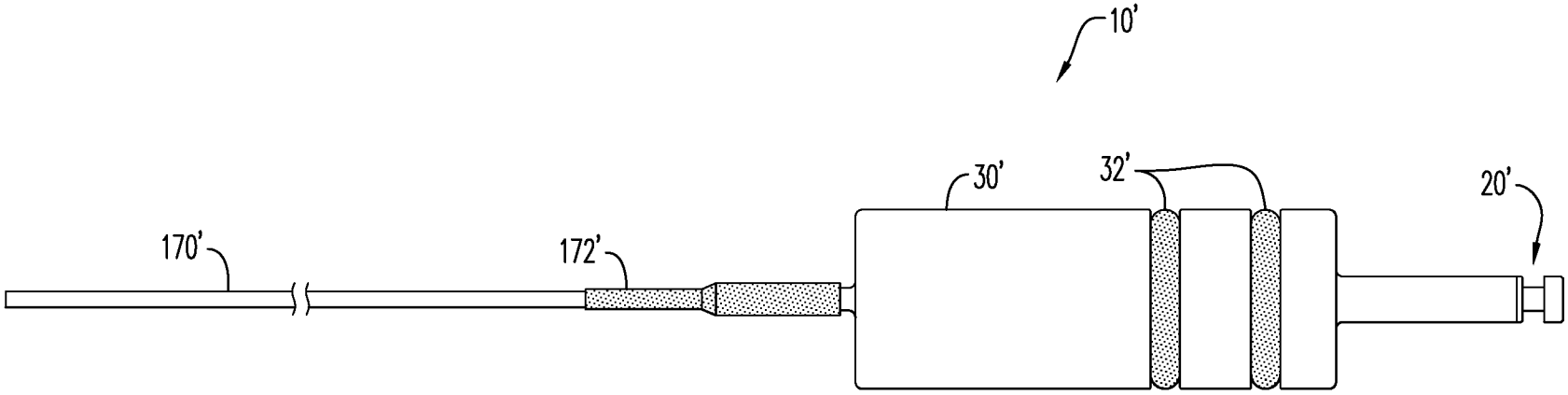
FIG. 1 (PRIOR ART)
FIG. 1 is a perspective view of a bulkhead assembly according to the prior art.

In an embodiment and with particular reference to FIGS. 1 and 2, the electrical contact component 20 includes one or more contact pins 21, a wire connection (not shown) or combinations thereof. In other words, it may be possible to assemble the bulkhead assembly 10 according to an aspect in which a contact pin 21 is replaced by the wire at, for instance a first end 22. Although this may limit the adaptability for the intended use, that is to freely pivot within the bulkhead to avoid binding, crimping or otherwise compromising the wire (and thus an electrical signal), having a single pivotable electrical contact component extending from an end of the bulkhead assembly 10 may still be advantageous over currently available assemblies.

According to an aspect, the electrical contact component 20 may include a plurality of contact pins 21, and each of the contact pins 21 include the first end 22 and a second end 23. In an embodiment, at least one of the contact pins 21 is slidably positioned within the bore 17 of the bulkhead body 12. In an embodiment, the contact pin includes a pin head 26 extending from a pin body 27. Typically, the contact pin may include a terminal contacting portion 28 extending from the pin body 27, opposite the pin head 26 for ease of facilitating the electrical connection.

Figure 3:
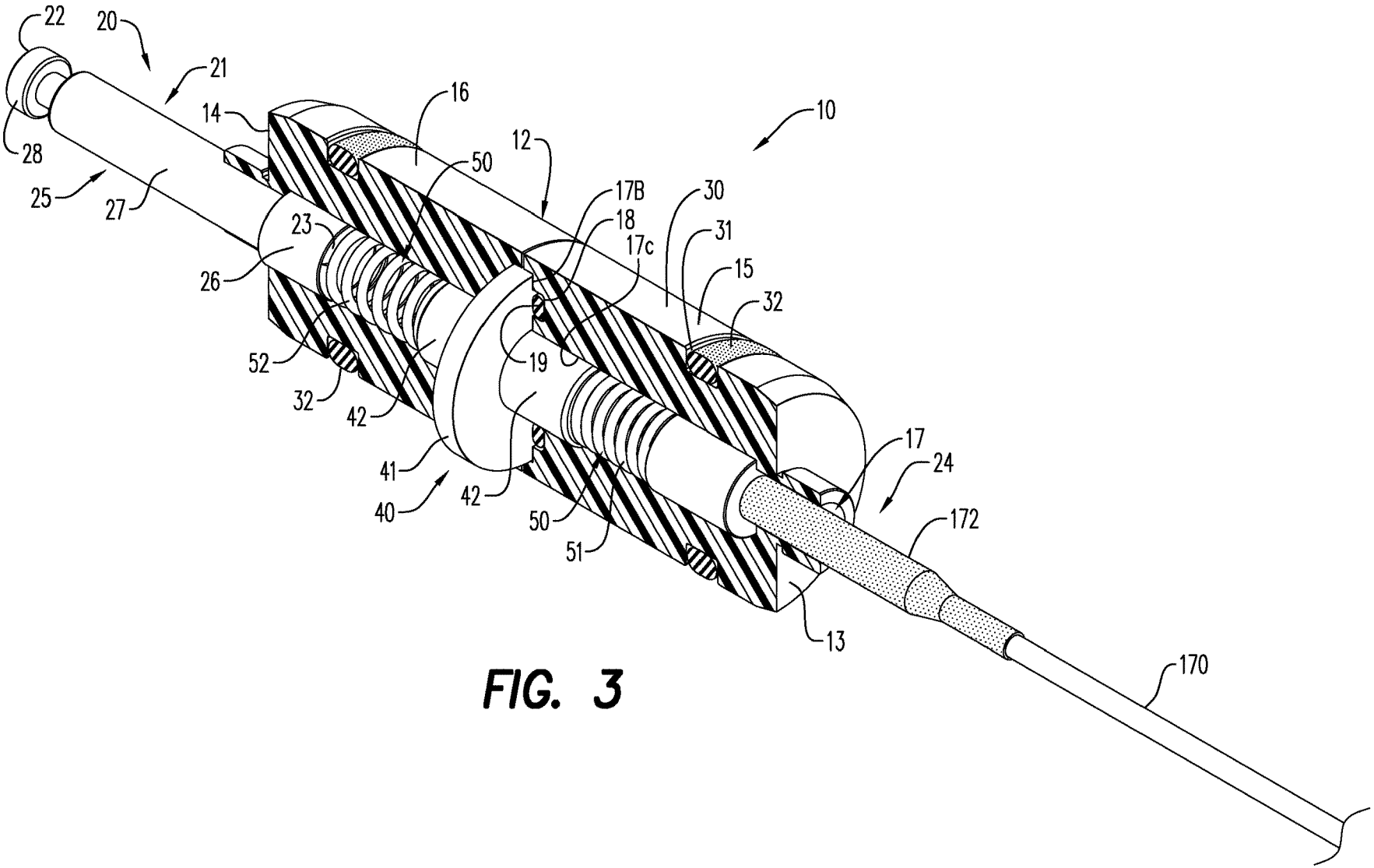
FIG. 3 is a cut-away perspective view of the bulkhead assembly of FIG. 2.

As shown in FIGS. 2 and 3, the bulkhead assembly 10 of the depicted embodiment includes a first contact pin 24 positioned at least partially within the first body portion 15 and extending from the first end portion 13 to an exterior or outer surface 30 of the assembly 10, while a second contact pin 25 is positioned at least partially within the second body portion 16 and extends from the second end portion 14 to the outer surface 30 of the assembly 10.

In an embodiment, the central bore portion 17*b* is typically configured to receive the central portion 40 of the electrical contact component 20, while a mid-portion bore 17*c* is typically configured to receive the pin head 26 and/or the biasing members 50 of the electrical contact component 20. In an embodiment, the central portion 40 and a plurality of biasing members 50 (such as a coil spring) are positioned within the bore 17 of the bulkhead body 12 with the biasing members abutting at least a portion of the central portion 40. In an embodiment, the central portion 40 of the electrical contact component 20 includes a disk-like central body 41 and arms 42 extending therefrom.

As depicted in FIGS. 2 and 3 and in an embodiment, the central portion bore 17*b* of the bore 17 includes a recessed portion 18, which is recessed from the central portion bore and configured to receive a bore sealing member 19. This seal will help to maintain the integrity of the bulkhead assembly 10 for sealing and maintaining pressure across the assembly as described in greater detail hereinbelow.

As shown herein, the plurality of biasing members 50 include a first biasing member 51 and a second biasing member 52. The first biasing member 51 is positioned within the bore 17 of a first body portion 15 of the bulkhead body 12, and the second biasing member 52 is positioned within the bore 17 of a second body portion 16 of the bulkhead body 12. More particularly and in this embodiment, the biasing members 50 are positioned within the mid-portion bore 17*c*. In a further embodiment, the plurality of biasing members 50 abut the central portion 40, and each of said biasing members 50 abuts at least one of the contact pins 21. In an embodiment, the first contact pin 24 abuts the first biasing member 51 and the second contact pin 25 abuts the second biasing member 52. It is further contemplated that it is possible to provide a rigid connection between at least one of the first contact pin 24 and the first biasing member 51 or the second contact pin 25 and the second biasing member 52.

According to an aspect, the pin head 26 of the contact pin is sized to be slidably received within the mid-portion bore 17*c* of the bore 17 of the bulkhead body 12. Thus, in a typical arrangement, the pin head 26 may have an enlarged radius relative to the radius of the pin body 27. In this way, the pin head 26 will be received within the mid-portion 17*c*, while the pin body 27 extends through the end portion bore 17*a* of the first or second end portion 13, 14, respectively.

In operation, the contact pins 21 are capable of rotation or swiveling or twisting or pivoting, (all of which are functions referred to generically herein as "pivot," "pivotable," "pivoting"), about its own axis A-A as shown by arrows D, and are rotatable or pivotable in either direction. This ability to pivot, or to be pivotable, about its own axis can be very useful during the loading procedure of hardware of a downhole tool 100 such as a perforating gun assembly where the twisting of the electrical cable attached to the bulkhead assembly 10 (typically crimped or soldered) would otherwise cause the cable connection to snap off unintentionally. The pivot function described herein allows at least portions of the electrical contact component 20 to pivot without building up tension in the cable to a point of snapping. In addition, the biasing members 50 may also compensate for unfavorable tolerance stack-up in the perforating gun assembly 100.

As shown herein, the axis A-A of the contact pins 21 coincides with the axis A-A of the bulkhead body 12. Furthermore, the contact pins 21 are capable of sliding backwards and forwards in the direction shown by arrows B, and such movement is limited by biasing members 50. In practice, the contact pin is capable of moving into and out of the body while restricted from leaving the bulkhead body 12 due to the smaller inner diameter of end portion bores 17*a*, and compressibility of biasing members 50 as the members 50 are pushed against the central portion 40. It is anticipated that a thickness of each of the first end portion 13 and the second end portion 14 are sized sufficiently to stop or retain at least a portion of the contact pin 21, and in an embodiment, to stop or retain the pin head 26 within the mid-portion bore 17*c*. Alternatively, it may be possible to fix or otherwise attach (rather than abut) each of the components of the electrical contact component 20 together (not shown). In other words, on one end of the electrical contact component 20, the first contact pin 24 may be attached to the first biasing member 51, which is attached to the central portion 40, while at the other end of the component, the second contact pin 25 may be attached to the second biasing member 52, which is attached to the central portion 40. In this way, it may not be necessary to provide first end portion 13 and second end portion 14 to retain the assembly within the bulkhead body 12.

Figure 5:
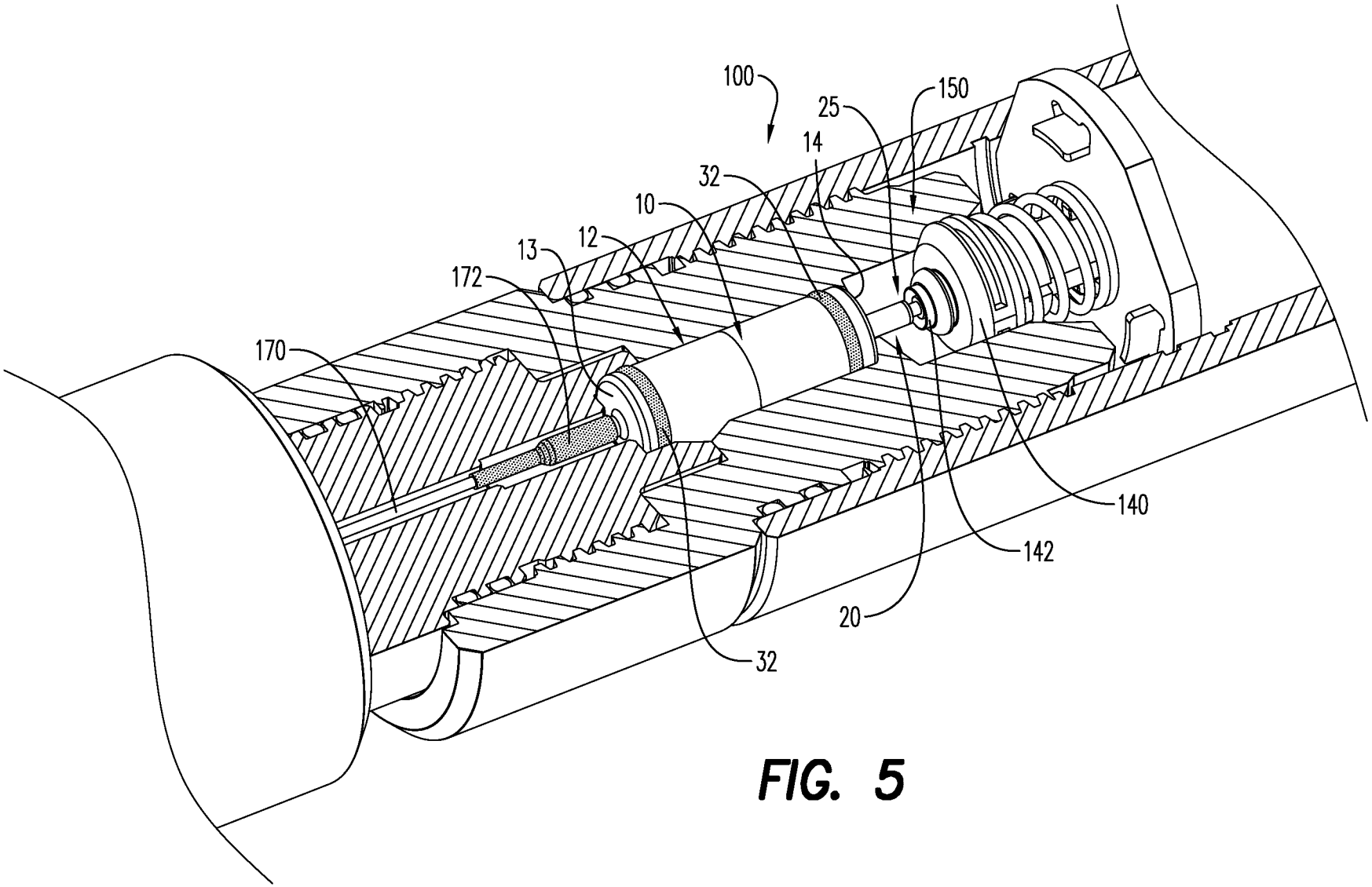
FIG. 5 is a partially cut-away perspective view of the bulkhead assembly assembled within a perforating gun assembly according to an aspect.

In an embodiment, the bulkhead assembly 10 is able to maintain a higher pressure at the first end portion 13 of the bulkhead body 12 as compared to the second end 14 of the bulkhead body 12, as depicted in an embodiment in, for instance, FIG. 5. In this embodiment, the bulkhead assembly 10 is positioned within the downhole tool 100, in this instance a perforating gun assembly. Any and all of the features of the bulkhead assembly 10 mentioned hereinabove are useful in the downhole tool 100 including the bulkhead assembly 10.

Only a portion of the downhole tool 100 is depicted herein, including a tandem seal adapter or tandem sub 150, in which the bulkhead assembly 10 is shown assembled within the perforating gun assembly 100. In an embodiment, the bulkhead assembly 10 is configured for positioning within the tandem seal adaptor 150. The tandem sub 150 is configured to seal inner components within the perforating gun housing from the outside environment using various sealing means. The tandem seal adapter 150 seals adjacent perforating gun assemblies (not shown) from each other, and houses the bulkhead assembly 10. As shown herein, the wired electrical connection 170 is connected to the first end 22 of the electrical contact component 20 of the bulkhead assembly 10 via the first contact pin 24 (not shown). An insulator 172 covers the first contact pin 24 and in an embodiment provides a coating or insulating member, typically using heat shrinking, over the connecting wires of the wired electrical connection 170.

Figure 4:
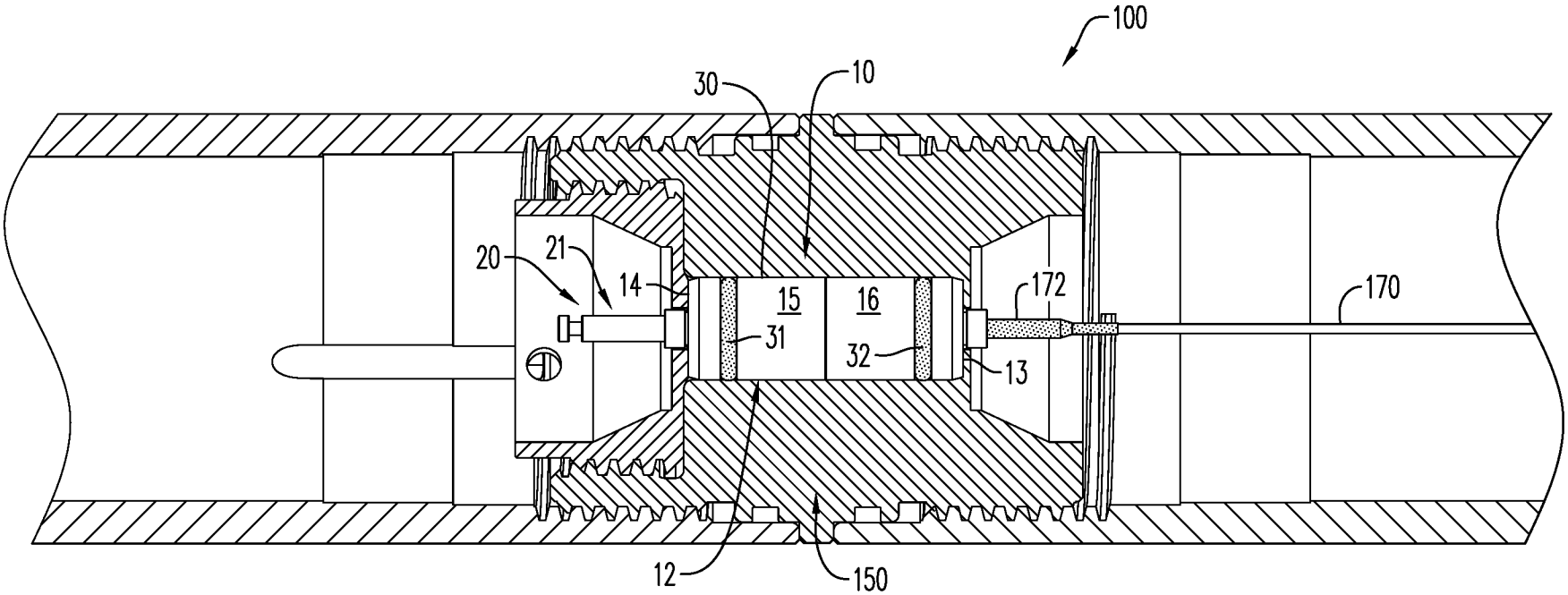
FIG. 4 is a partially cut-away side view of the bulkhead assembly assembled within a perforating gun assembly according to an aspect.

In an embodiment, and as shown particularly in FIGS. 4 and 5, the bulkhead assembly 10 functions to relay the electrical signal via the electrical contact component 20 to an initiator 140, such as a detonator or igniter. In particular and as shown in FIG. 5, the second contact pin 25 is in contact with a spring loaded electric contact, which is connected to the initiator 140. In an embodiment and as shown herein, the first contact pin 24 (see, for instance, FIG. 2, and which is covered by the insulator 172 in FIG. 5) is configured for connecting to the wired electrical connection 170 and the second contact pin 25 is configured for wirelessly electrically contacting an electrical contact, such as a detonator electrical contacting component 142, to transmit the electrical signal. In a further embodiment, the second contact pin 25 is configured for wirelessly electrically contacting an electrical contact of the initiator 140.

Figure 6:
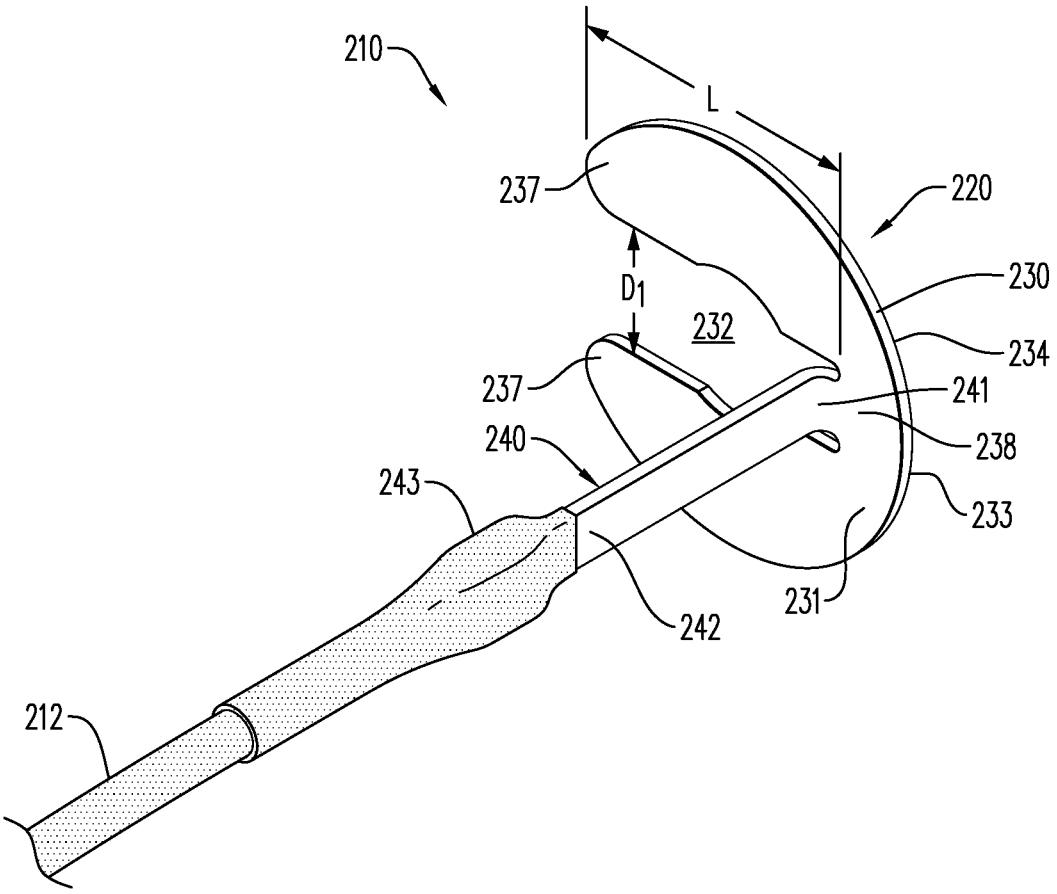
FIG. 6 is a perspective view of a ground apparatus according to an aspect.
Figure 7:
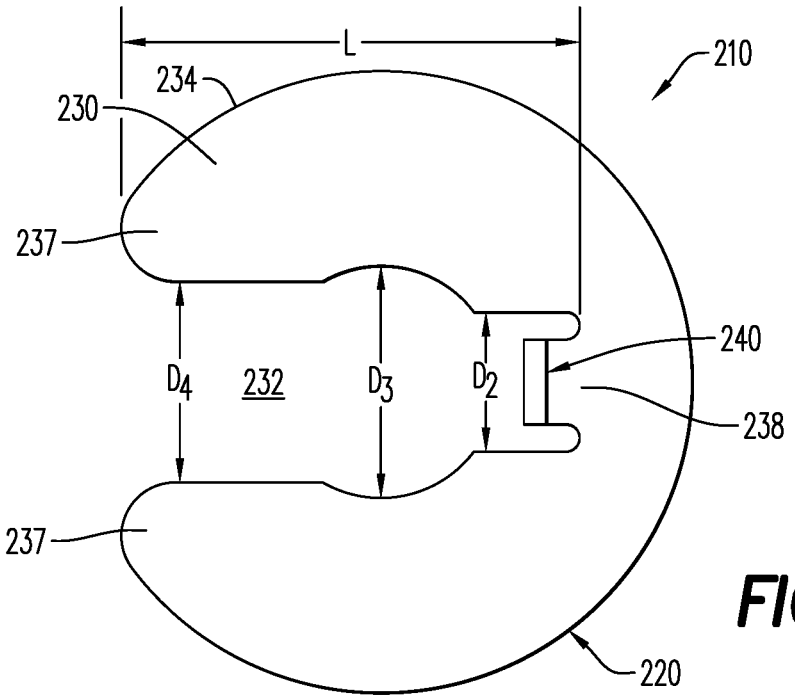
FIG. 7 is a top view of a ground apparatus according to an aspect.
Figure 9A:
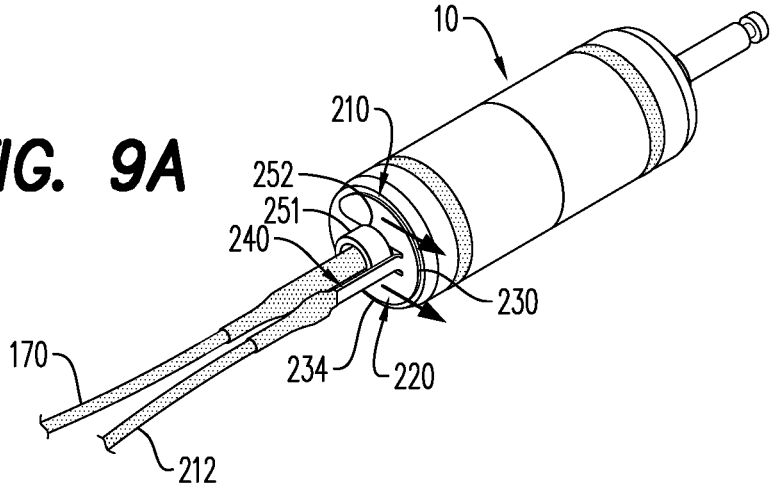
FIGS. 9A-9C are perspective views showing a ground apparatus positioned on a bulkhead assembly according to an aspect.
Figure 9B:
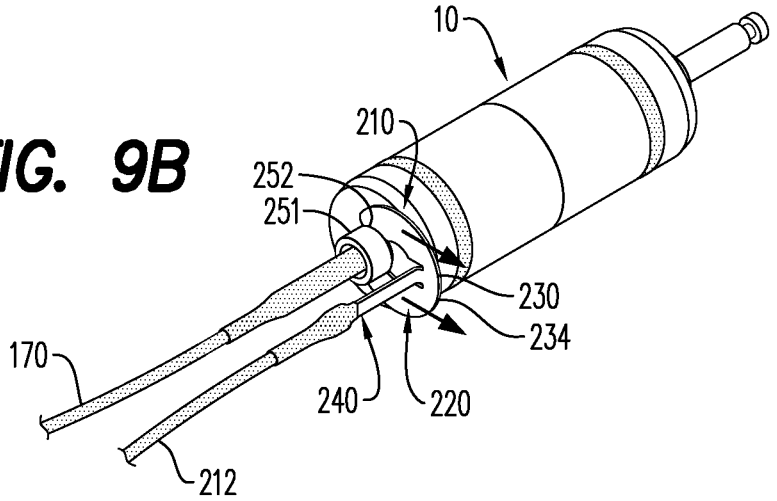
Figure 9C:
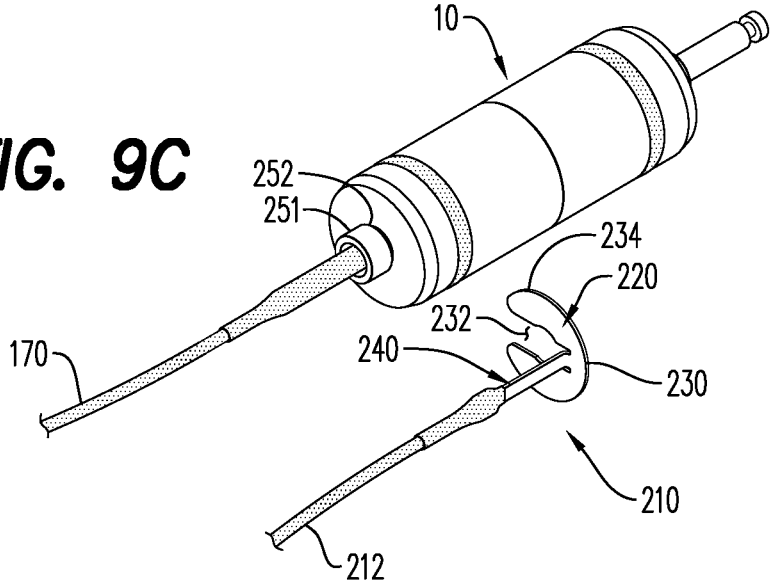

With reference to FIGS. 6-7, a ground apparatus 210 is provided and is configured for providing an electrical connection for at least one ground wire 212. According to an aspect, the ground apparatus may be configured to be received by a receiving member 251 (substantially as shown in FIGS. 9A-9C and described substantially hereinbelow). The ground apparatus 210 may provide a ground apparatus to the electrical contact component of the bulkhead assembly 10 by providing a simple means to ground/attach the ground wire 212. (See, for instance, FIGS. 10-13.)

Figure 12:
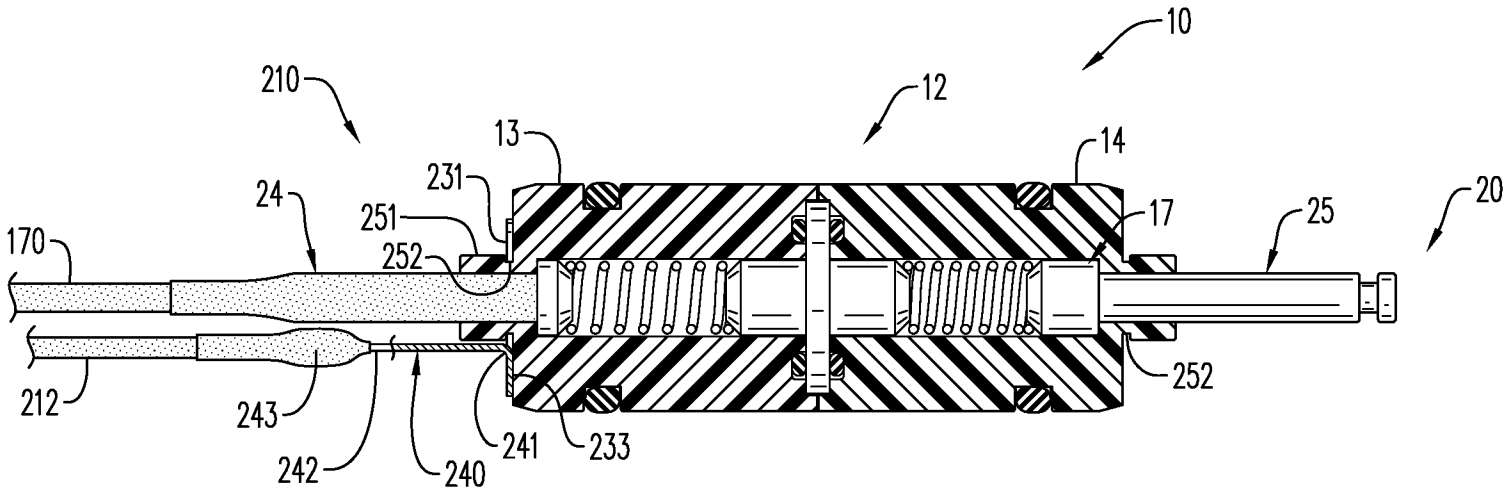
FIG. 12 is a cross-sectional view of a bulkhead assembly having a ground apparatus according to an aspect.

According to an aspect, the ground apparatus 210 may include a plate 220 and a contact arm 240 extending from the plate 220. The plate 220 may include a grounding body 230 including an upper surface 231 and a lower surface 233. According to an aspect, the ground apparatus 210 includes a contact arm 240, which may be formed integrally with and extend from the grounding body 230. While FIG. 6 and FIG. 12 illustrates the contact arm 240 extending out of or away from the upper surface 231, it is to be understood that in some embodiments, the contact arm 240 extends out of or away from the lower surface 233. The contact arm 240 may include an inner portion 241 and an outer portion 242, such that the inner portion 241 extends from the base 238 of the grounding body 230 and the outer portion 242 extends beyond the inner portion 241. The outer portion 242 of the contact arm 240 may include a connecting means 243 for mechanically and electrically connecting to the ground wire 212, thereby providing an electrical ground connection. The connecting means 243 may include, for example, plastic sheathing cables, electrical tape, a clip and insulator, and the like.

According to an aspect and as illustrated in FIG. 7, the plate 220 of the ground apparatus 210 includes at least a semi-disc shape. The plate 220 may have any other shape, such as a rectangular shape. According to an aspect, the plate 220 includes a ductile bendable sheet metal having conductive properties. In an embodiment, the plate 220 includes aluminum, copper, copper alloys and or any other electrically conductive materials. According to an aspect, the contact arm 240 is formed integrally with the grounding body 230 by virtue of being formed from the partially cut or stamped-out section of the grounding body 230.

The grounding body 230 may include an aperture 232. As illustrated in FIG. 7, the grounding body 230 may include the aperture 232 extending from a perimeter 234 of the grounding body 230 substantially inwards and substantially towards a central portion of the grounding body 230. The arrangement and/or formation of the aperture 232 in the grounding body 230 may form fingers 237 on either side of the grounding body 230. The fingers 237 may extend from a base 238 of the grounding body 230. According to an aspect, the fingers 237 extend substantially from the base 238 towards the perimeter 234 of the grounding body 230. In an embodiment, the length L of the fingers 237 defines the depth of the aperture 232 and is the distance from the base 238 of the grounding body 230 to the perimeter 234. The length L may be of any size and shape that would enable the fingers 237 to engage with the receiving member 251, as will be discussed in greater detail hereinbelow. According to an aspect, a distance D1 defines the width of the aperture 232, between the fingers 237. In an embodiment, the distance D1 is created by virtue of the stamped out section of the grounding body 230, i.e., the D1 is substantially same as a size and/or dimensions of the contact arm 240.

With particular reference to FIG. 7, the distance D1 may include an inner distance D2, a central distance D3 and an outer distance D4. According to an aspect, the central distance D3 may have a larger size than the inner distance D2 and/or the outer distance D4. According to an aspect, the central distance D3 may be sized and adapted to provide the pivoting capabilities of the ground apparatus 210. In an embodiment, the central distance D3 is designed to have a substantially circular shape. According to an aspect, when the outer distance D4 is smaller in size than the central distance D3, the outer distance D4 provides retention capabilities when the ground apparatus 210 is snapped or otherwise positioned on, for example, the bulkhead assembly 10 and/or engaged with the receiving member 251, as seen, for instance, in FIG. 9A.

Figure 8:
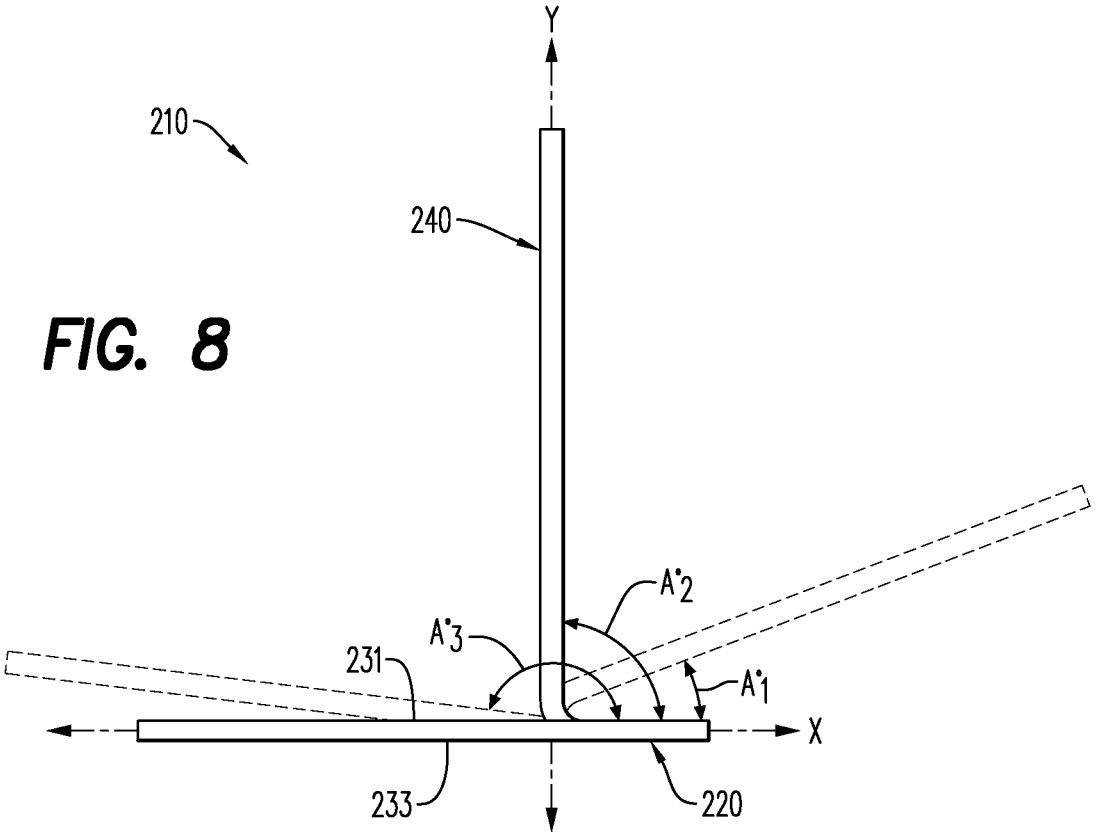
FIG. 8 is a side view of a ground apparatus according to an aspect.

As illustrated in FIG. 8, the contact arm 240 extends from the plate 220, and thus is positioned away from the upper surface 231 of the grounding body 230. According to an aspect, the contact arm 240 projects away from the plate 220 at an angle A°. The angle A° may be between about 10 degrees $A°_1$ and about 170 degrees $A°_3$. According to an aspect, the angle A° is between about 10 degrees $A°_1$ and about 90 degrees $A°_2$. As described hereinabove, the grounding body 230 may be configured for pivoting about its own axis when positioned on the electrical device and/or the receiving member 251. In any event, the angle A° may be selected so that when the grounding body 230 pivots about its own axis, the ground wire 212 will not be torn, twisted and/or crimped/nicked, i.e., the ground wire 212 will not become compromised. In other words, the grounding apparatus 210 may be able to provide continuous and/or successful electrical connection for the ground wire 212 while also being pivotable on the bulkhead assembly 10 and/or the receiving member 251, thereby helping to at least reduce and/or limit the safety issues associated with physically and manually wiring live explosives.

As illustrated in FIGS. 9A-9C and according to an aspect, the ground apparatus 210 is removeably positioned on the receiving member 251 of the bulkhead assembly 10. According to an aspect, the grounding body 230 is at least partially positioned in a groove 252 formed in the receiving member 251. When positioned in the groove 252, the grounding body 230 is pivotable about its own axis. In an embodiment, when the grounding wire 212 is attached to the contact arm 240 of the ground apparatus, the ground apparatus 210 is pivotable in such a manner that the grounding wire 212 will not become compromised. Further, by virtue of being attached to the ground apparatus 210, the grounding wire 212 is also capable of being removeably positioned and/or connected to the receiving member 251.

According to an aspect and as illustrated in FIGS. 9A-9B, when the ground apparatus 210 is positioned on the receiving member 251, the perimeter 234 of the grounding body 230 may have a shape that is substantially similar to the shape of the bulkhead assembly 10. In some embodiments, the perimeter 234 of the grounding body 230 has a shape that is not similar to the shape of the bulkhead assembly 10 (not shown).

FIGS. 9A-9C illustrate the ground apparatus 210 being removed from the receiving member 251, according to an aspect. When the ground apparatus 210 is removed from the receiving member, it can be easily repositioned thereon without requiring additional devices, such as, for example, clips and/or fasteners. The grounding apparatus 210 may function as an integrated device having all the components required for providing continuous and/or successful electrical contact.

With reference to FIGS. 10-13 and according to an aspect, a bulkhead assembly 10 having an integrated ground apparatus is provided. The bulkhead assembly 10 is illustrated including a bulkhead body 12 and an electrical contact component 20. According to an aspect, the bulkhead body 12 includes a first end portion 13, a second end portion 14 and a bore 17 (see FIG. 12) extending between the first end portion 13 and the second end portion 14. The electrical contact component 20 may extend through the bore 17 of the bulkhead body 12, such that at least a portion of the electrical contact component 20 is configured to pivot about its own axis. According to an aspect, the electrical contact component 20 is configured for electrical conductivity and feed-through of the electric signal.

Figure 10:
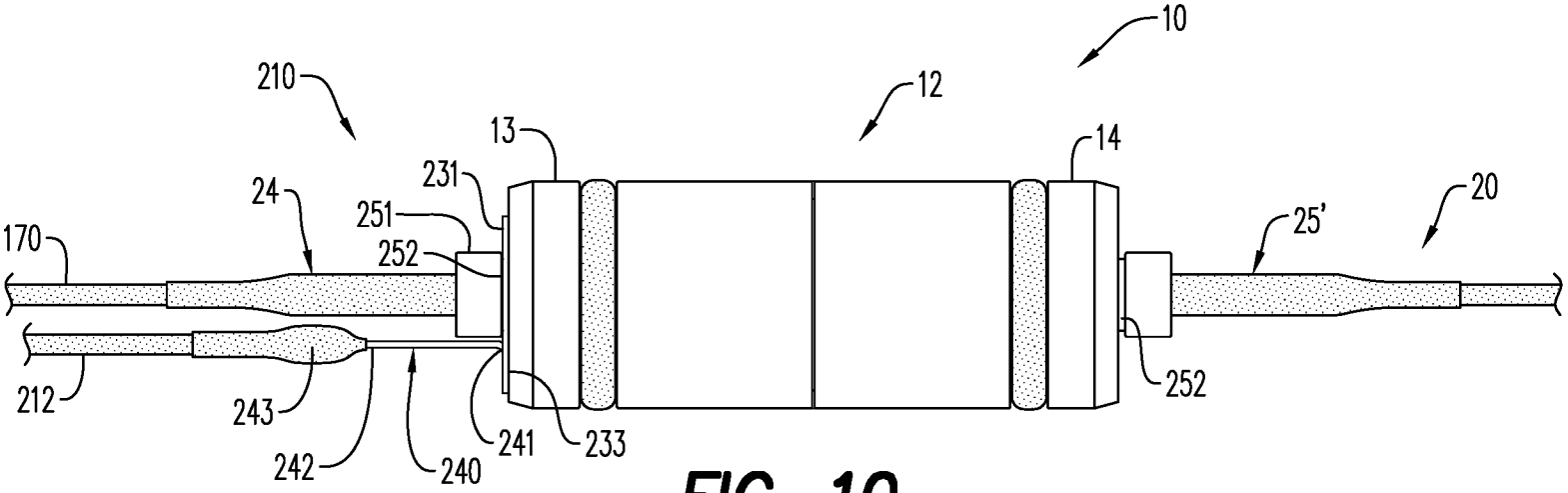
FIG. 10 is a side view of a ground apparatus positioned on a bulkhead assembly for use with a wired initiator, according to an aspect.
Figure 11:
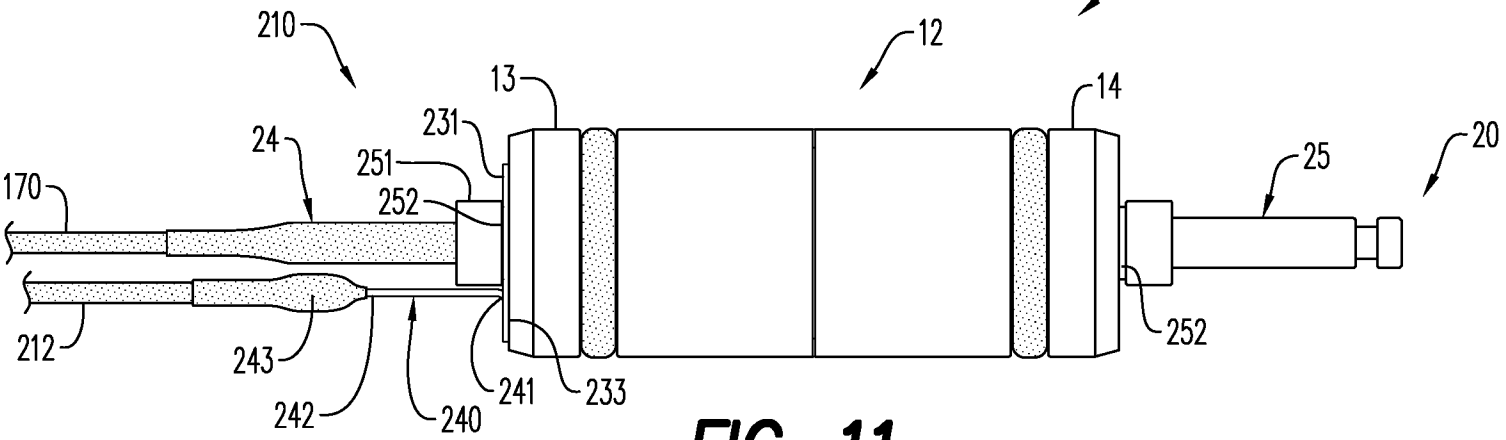
FIG. 11 is a side view of a ground apparatus positioned on a bulkhead assembly for use with a wireless initiator, according to an aspect.

With reference to FIGS. 10-11 and according to an aspect, the bulkhead assembly 10 includes the first contact pin 24 extending from the first end portion 13 and the second contact pin 25, 25' extending from the second end portion 14, with the ground apparatus 210 positioned adjacent to the first end portion 13 of the bulkhead body 12. According to an embodiment, and as illustrated in FIG. 10, the first contact pin 24 is configured for connecting to the wired electrical connection 170 and the second contact pin 25' is configured for providing a wired electrical connection to, for instance, a wired initiator (not shown), to transmit the electrical signal. In an alternative embodiment and as illustrated in FIG. 11, the first contact pin 24 is configured for connecting to the wired electrical connection 170 and the second contact pin 25 is configured for providing a wireless electrical connection to the wireless detonator electrical contacting component 142, (see, for instance, FIG. 5), to complete the electrical connection and to transmit the electrical signal. According to an aspect, when the ground apparatus 210 is positioned within the groove 252 formed in the receiving member 251, the ground apparatus 210 can rotate/swivel/pivot about the receiving member 251 in a manner that does not compromise the grounding wire 212. According to an aspect, the pivot function of the ground apparatus 210 relative to the bulkhead assembly 10 prevents the grounding wire 212 from becoming torn, crimped/nicked, inadvertently disconnected from the receiving member 251, and allows the ground apparatus 210 to pivot or twist around the receiving member 251 as the electrical contact component 20 pivots within the bulkhead body 12 of the bulkhead assembly 10.

Figure 13:
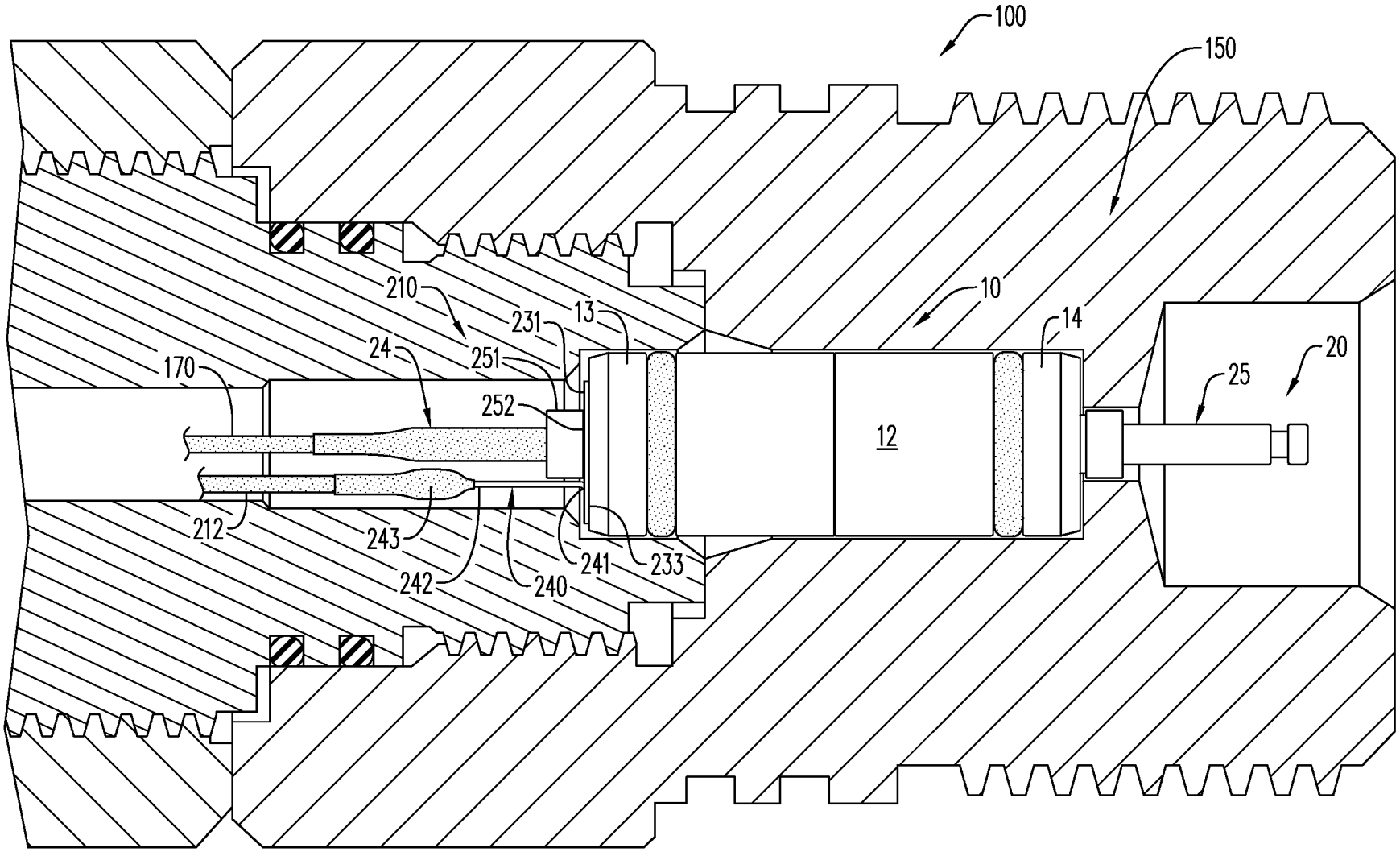
FIG. 13 is a partially cut-away side view a bulkhead assembly having a ground apparatus and assembled within a perforating gun assembly according to an aspect.

FIG. 13 illustrates a downhole tool 100 including the bulkhead assembly 10 having the integrated ground apparatus 210, according to an aspect. The downhole tool 100 may include the tandem seal adapter 150 (FIG. 4) and the ground apparatus 210 pivotally attached to or assembled on the bulkhead assembly 10 within the tandem seal adapter 150, in such a manner that the inner components within the bulkhead assembly 10 are sealed within the tandem seal adapter 150. In other words, the tandem seal adapter 150 may house and seal the bulkhead assembly 10 and its respective ground apparatus 210 from adjacent perforating gun assemblies (not shown).

In an embodiment, the bulkhead assembly 10 provides an improved apparatus for use with a wireless connection—that is, without the need to attach, crimp, cut or otherwise physically and manually connect external wires to the component. Rather, one or more of the connections may be made wirelessly, by simply abutting, for instance, electrically contactable components. For the sake of clarity, the term "wireless" does not refer to a WiFi connection, but rather to this notion of being able to transmit electrical signals through the electrical componentry without connecting external wires to the component.

In an embodiment, the bulkhead assembly 10 is provided that is capable of being placed into the downhole tool 100 with minimal effort. Specifically, bulkhead assembly 10 is configured for use in the downhole tool 100 and to electrically contactably form an electrical connection with the initiator 140 or other downhole device, for instance, to transmit the electrical signal without the need of manually and physically connecting, cutting or crimping wires as required in a wired electrical connection.

The components and methods illustrated are not limited to the specific embodiments described herein, but rather, features illustrated or described as part of one embodiment can be used on or in conjunction with other embodiments to yield yet a further embodiment. Such modifications and variations are intended to be included. Further, steps described in the method may be utilized independently and separately from other steps described herein.

While the apparatus and method have been described with reference to preferred embodiments, it will be understood by those skilled in the art that various changes may be made and equivalents may be substituted for elements thereof without departing from the scope. In addition, many modifications may be made to adapt a particular situation or material to the teachings without departing from the essential scope thereof. In the interest of brevity and clarity, and without the need to repeat all such features, it will be understood that any feature relating to one embodiment described herein in detail, may also be present in an alternative embodiment. As an example, it would be understood by one of ordinary skill in the art that if the electrical contact component 20 of one embodiment is described as being formed of an electrically conductive material, that the electrical contact component 20 described in the alternative embodiment is also formed of an electrically conductive material, without the need to repeat all such features.

In this specification and the claims that follow, reference will be made to a number of terms that have the following meanings. The singular forms "a," "an" and "the" include plural referents unless the context clearly dictates otherwise. Furthermore, references to "one embodiment" are not intended to be interpreted as excluding the existence of additional embodiments that also incorporate the recited features. Terms such as "first," "second," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of."

Advances in science and technology may make equivalents and substitutions possible that are not now contemplated by reason of the imprecision of language; these variations should be covered by the appended claims. This written description uses examples, including the best mode, and also to enable any person of ordinary skill in the art to practice, including making and using any devices or systems and performing any incorporated methods. The patentable scope is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A seal adapter assembly for sealing a downhole tool, the seal adapter assembly comprising:

a seal adapter having an attachment component configured to attach the seal adapter to the downhole tool;

a bore extending through the seal adapter;

a bulkhead comprising:

a bulkhead body having an outer surface, a first end and a second end, the outer surface of the bulkhead body being sealingly received in the seal adapter bore;

a bulkhead bore extending through the bulkhead body from the first end to the second end; and an electrical contact component received within the bulkhead bore and configured for electrical conductivity through the bulkhead body, wherein the bulkhead body and the electrical contact component have a common longitudinal axis, at least a portion of the electrical contact component is configured to pivot relative to the bulkhead body, and the electrical contact component further comprises:

a conductive interior piece provided within the bulkhead bore;

a bore seal provided between the conductive interior piece and the bulkhead body.

2. The seal adapter assembly of claim 1, wherein the electrical contact component includes a first end adjacent the bulkhead body first end and a second end adjacent the bulkhead body second end and it is not possible to interrupt electrical conductivity from the first end to the second end of the electrical contact component.

3. The seal adapter assembly of claim 1, wherein the seal adapter assembly is configured to maintain a pressure differential between the first end and second end of the bulkhead body when the seal adapter is attached to the downhole tool.

4. The seal adapter assembly of claim 3, further comprising:

a wire extending through the first end of the bulkhead body and attached to the electrical contact component.

5. The seal adapter assembly of claim 4, further comprising:

an insulator between the wire and the first end of the bulkhead body.

6. The seal adapter assembly of claim 1, wherein the electrical contact component further comprises:

a contact slidably disposed within the bulkhead bore; and a biasing member contacting the conductive interior piece and the contact, and applying a biasing force on the contact in a direction away from the conductive interior piece.

7. The seal adapter assembly of claim 6, wherein the contact is a pin contact comprising:

a pin shaft having a first radius; and a pin head positioned within the bulkhead bore, the pin head portion having a second radius greater than the first radius of the pin shaft.

8. The seal adapter assembly of claim 7, wherein the bulkhead bore comprises an end bore extending through second end, wherein the end bore has an end bore radius that is smaller than a radius of the bulkhead bore extending between the first end and the second end.

9. The seal adapter assembly of claim 8, wherein the first radius of the pin shaft is less than the end bore radius; and the second radius of the pin head is greater than the end bore radius.

10. The seal adapter assembly of claim 8, wherein the second radius of the pin head is sized to be slidably received within the bulkhead bore.

11. The seal adapter assembly of claim 7, wherein the pin shaft is disposed through the second end of the bulkhead body.

12. The seal adapter assembly of claim 1, wherein a position of the conductive interior piece is fixed axially and radially with respect to the bulkhead body.

13. A seal adapter assembly for sealing a downhole tool, the seal adapter assembly comprising:

a seal adapter having an attachment component configured to attach the seal adapter to the downhole tool, a bore extends through the seal adapter;

a bulkhead body having an outer surface, a first end, a second end and a bulkhead body bore extends through the bulkhead body, the outer surface of the bulkhead body is sealingly received in the seal adapter bore; and an electrical contact component extends through the bulkhead body bore and is configured to provide electrical conductivity through the bulkhead body, the electrical contact component including a contact pin portion connected to a pin head portion, a radius of the contact pin portion is less than a radius or the pin head portion, wherein the bulkhead body and the electrical contact component have a common longitudinal axis and at least the contact pin portion of the electrical contact component is configured to pivot relative to the bulkhead body;

wherein the electrical contact component further comprises:

a conductive interior piece provided within the bulkhead bore; and a bore seal provided between the conductive interior piece and the bulkhead body.

14. The seal adapter assembly of claim 13, further comprising:

a biasing member positioned within the bulkhead body bore, wherein the biasing member exerts a force on the pin head portion, the bulkhead body bore includes a main bore portion and a second end bore portion, and the radius of the pin head portion is less than a main bore portion radius and greater than a second end bore portion radius.

15. The seal adapter assembly of claim 13, wherein the electrical contact component includes a first end adjacent the bulkhead body first end and a second end adjacent the bulkhead body second end and it is not possible to interrupt electrical conductivity from the first end to the second end of the electrical contact component.

16. The seal adapter assembly of claim 15, further comprising at least one of:

a ground wire attached to the bulkhead body; and a wire extending through the first end of the bulkhead body and attached to the electrical contact component.

17. The seal adapter assembly of claim 13, wherein a position of the conductive interior piece is fixed axially and radially with respect to the bulkhead body.

18. A bulkhead comprising:

a bulkhead body having an outer surface, a first end, and a second end;

a bulkhead bore extending through the bulkhead body from the first end to the second end; and an electrical contact component received within the bulkhead bore and configured for electrical conductivity through the bulkhead body, wherein the bulkhead body and the electrical contact component have a common longitudinal axis, at least a portion of the electrical contact component is configured to pivot relative to the bulkhead body, and the electrical contact component further comprises:

a conductive interior piece provided within the bulkhead bore; and a bore seal provided between the conductive interior piece and the bulkhead body.

19. The bulkhead of claim 18, wherein the electrical contact component further comprises:

a contact slidably disposed within the bulkhead bore; and a biasing member contacting the conductive interior piece and the contact and applying a biasing force on the contact in a direction away from the conductive interior piece.

20. The bulkhead of claim 19, wherein a position of the conductive interior piece is fixed axially and radially with respect to the bulkhead body.

* * * * *